US011127357B2

(12) United States Patent
Ryu et al.

(10) Patent No.: US 11,127,357 B2
(45) Date of Patent: Sep. 21, 2021

(54) DISPLAY PIXEL LUMINANCE STABILIZATION SYSTEMS AND METHODS

(71) Applicant: Apple Inc., Cupertino, CA (US)

(72) Inventors: Jie Won Ryu, Santa Clara, CA (US); Myungjoon Choi, Sunnyvale, CA (US); Hyunsoo Kim, Mountain View, CA (US); Hyunwoo Nho, Palo Alto, CA (US); Chin-Wei Lin, San Jose, CA (US); Shiping Shen, Cupertino, CA (US); Kingsuk Brahma, Mountain View, CA (US); Chaohao Wang, Sunnyvale, CA (US); Shinya Ono, Cupertino, CA (US); Alex H. Pai, Milpitas, CA (US); Hassan Edrees, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 16/850,936

(22) Filed: Apr. 16, 2020

(65) Prior Publication Data

US 2020/0335046 A1 Oct. 22, 2020

Related U.S. Application Data

(60) Provisional application No. 62/836,595, filed on Apr. 19, 2019.

(51) Int. Cl.
*G09G 3/30* (2006.01)
*G09G 3/3291* (2016.01)

(52) U.S. Cl.
CPC ... *G09G 3/3291* (2013.01); *G09G 2300/0842* (2013.01); *G09G 2310/0259* (2013.01);
(Continued)

(58) Field of Classification Search
CPC ..... G09G 3/30; G09G 3/3233; G09G 3/3275; G09G 3/3291; G09G 2300/0814;
(Continued)

(56) References Cited

U.S. PATENT DOCUMENTS 9,858,863 B2 1/2018 Kim et al.
2004/0207614 A1* 10/2004 Yamashita ..... G09G 3/3291 345/211

(Continued)

*Primary Examiner* — Michael J Eunice
(74) *Attorney, Agent, or Firm* — Fletcher Yoder, P.C.

(57) ABSTRACT

Techniques for implementing and/or operating an electronic device, which includes a display pixel that emits light to facilitate displaying an image during an emission period and a data driver coupled to the display pixel via a data line. The data driver generates a data line voltage signal based on image data that indicates target luminance of the display pixel in the image and supplies the data line voltage signal to the data line during a non-emission period preceding the emission period to facilitate writing the image to the display pixel. Additionally, the data driver supplies an intermediate voltage greater than a ground voltage to the data line during the emission period in which the image is displayed to facilitate reducing luminance variation in the image resulting from a leakage current flowing between an internal node of the display pixel and the data line during the emission period.

20 Claims, 14 Drawing Sheets

(52) U.S. Cl.
CPC ..... *G09G 2310/066* (2013.01); *G09G 2320/0214* (2013.01); *G09G 2320/0233* (2013.01)

(58) Field of Classification Search
CPC ... G09G 2300/0819; G09G 2300/0842; G09G 2310/0259; G09G 2310/066; G09G 2320/0214; G09G 2320/0219; G09G 2320/0233; H01L 29/78609
See application file for complete search history.

(56) References Cited

U.S. PATENT DOCUMENTS

| | | | | |
|---|---|---|---|---|
| 2006/0007074 | A1* | 1/2006 | Ono | G09G 3/3241 345/76 |
| 2007/0007528 | A1* | 1/2007 | Tsujimura | H01L 29/42384 257/59 |
| 2009/0015522 | A1* | 1/2009 | Ono | G09G 3/3258 345/76 |
| 2016/0148578 | A1* | 5/2016 | Kishi | G09G 3/3291 345/212 |
| 2017/0076671 | A1* | 3/2017 | Kim | G09G 3/3266 |
| 2018/0061311 | A1* | 3/2018 | Lin | G09G 3/3233 |
| 2018/0174514 | A1* | 6/2018 | Lee | H05B 45/10 |
| 2020/0193917 | A1* | 6/2020 | Park | G09G 3/3258 |

* cited by examiner

DISPLAY PIXEL LUMINANCE STABILIZATION SYSTEMS AND METHODS

CROSS-REFERENCE TO RELATED APPLICATIONS

This application claims priority to and the benefit of U.S. Provisional Application No. 62/836,595, filed Apr. 19, 2019, and entitled, "DISPLAY PIXEL LUMINANCE STABILIZATION SYSTEMS AND METHODS," which is incorporated herein by reference in its entirety for all purposes.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure generally relates to electronic displays, which may be used to present visual representations of information as one or more images (e.g., image frames and/or pictures). To display an image, an electronic display may control light emission from display pixels implemented on its display panel based at least in part on corresponding image data, which indicates target characteristics of the image. For example, the image data may indicate target grayscale (e.g., luminance) level at various points (e.g., image pixels) in the image.

Additionally, light emission from a display pixel generally varies with the magnitude of electrical energy stored therein. For example, in some instances, a display pixel may include a light emissive element, such as an organic light-emitting diode (OLED), that varies its light emission with current flowing therethrough, a current control switching device (e.g., transistor) coupled between the light emissive element and a pixel power (e.g., $V_{DD}$) supply rail, and a storage capacitor coupled to a control (e.g., gate) terminal of the current control switching device at an internal node of the display pixel. As such, varying the amount of energy stored in the storage capacitor may vary voltage applied to the control input of the current control switching device and, thus, magnitude of electrical current supplied from the pixel power supply rail to the light emissive element. In other words, at least in such instances, light emission from a display pixel may be controlled at least in part by controlling magnitude of electrical power (e.g., voltage and/or current) supplied to its internal node. However, it should be appreciated that the OLED examples described in the present disclosure are merely intended to be illustrative and not limiting.

To facilitate controlling magnitude of electrical power supplied to its display pixels, a display panel generally includes a scan driver coupled to groups (e.g., rows) of display pixels via corresponding scan lines and a data driver coupled to groups (e.g., columns) of display pixels via corresponding data lines. Additionally, a display pixel may include one or more scan control switching devices (e.g., transistors) coupled between its internal node and a corresponding data line. In other words, to write the display pixel, the one or more scan control switching devices may each be switched to and maintained in its connected (e.g., conductive or closed) state, thereby enabling a data line voltage signal supplied to the data line to adjust electrical energy stored in its storage capacitor and, thus, resulting light emission.

Generally, an electronic display may alternate between non-emission (e.g., refresh or writing) periods during which images are written and emission (e.g., display) periods during which images are displayed based on electrical energy stored in its display pixels during a preceding non-emission period. In other words, before a subsequent emission period, one or more scan control switching devices (e.g., transistors) in a display pixel may be switched to and maintained in its disconnected (e.g., non-conductive or open) state, thereby breaking (e.g., blocking) a direct (e.g., primary) electrical path between the internal node of the display pixel and a corresponding data line. However, at least in some instances, light emission from a display pixel may nevertheless vary during display of an image, for example, due to leakage current flowing through one or more of its switching devices that are in the disconnected state. At least in some instances, changes in light emission during display of an image (e.g., relative to itself, a preceding image, and/or a subsequent image) may be perceivable as a visual artifact, such as a perceivable flicker, that affects (e.g., reduces) perceived quality of the image and, thus, a potentially an electronic display that is displaying the image.

Accordingly, to facilitate improving perceived image quality, the present disclosure provides techniques for implementing and/or operating an electronic display to reduce likelihood and/or perceivability of visual artifacts, such as a perceivable flicker, resulting in displayed images, for example, by reducing the effect leakage current has on light emission from its display pixels. To facilitate reducing the effect of leakage current on light emission (e.g., pixel luminance), in some embodiments, an electronic display may include a data driver implemented and/or operated to supply one or more intermediate voltages, which are each greater than a ground voltage, to data lines of the electronic display during an emission period in which an image is displayed. In other words, in some embodiments, the data driver may be implemented and/or operated to supply a non-zero (e.g., intermediate) voltage to a data line coupled thereto during display (e.g., emission period) of the image, for example, instead of constantly holding the data line at a ground (e.g., zero) voltage. Since the voltage difference between a target internal node voltage of a display pixel coupled to the data line and the intermediate (e.g., non-zero) voltage may be less than the voltage between the target internal voltage and the ground voltage, at least in some embodiments, supplying the intermediate voltage to the data line during the emission period may facilitate reducing the magnitude of resulting leakage current and, thus, a resulting variation (e.g., change) in pixel luminance during display of the image.

However, at least in some embodiments, some amount of leakage current may nevertheless occur and, thus, flow through a corresponding data line even when the data line is supplied an intermediate voltage during the emission period. Additionally, due to parasitic capacitance between a data line and electrical conductive material implemented in a display pixel, in some embodiments, electrical current flowing through the data line may result in electrical current flowing through an internal node of the display pixel. In fact, in some embodiments, a change in voltage over time (e.g., dv/dt) resulting from leakage current flowing through a data line may combine with the change in internal node voltage resulting from leakage current of a display pixel to produce a multi-order (e.g., second-order) response in the internal node voltage and, thus, resulting light emission from the display pixel.

To facilitate stabilizing a multi-order response, in some embodiments, a data driver may be implemented and/or operated to ramp a data line voltage to multiple intermediate voltages during an emission period in which an image is display. In other words, in some embodiments, the data driver may apply a voltage ramp pattern to a data line during the emission period, for example, instead of holding the data line constantly at a single intermediate voltage. As an illustrative example, during an emission period of an image, the data driver may ramp a data line voltage from a ground voltage to a first intermediate voltage at a first target ramp time, from the first intermediate voltage to a second intermediate voltage at a second target ramp time, and so on. In some embodiments, the change in voltage over time (e.g., dv/dt) resulting from ramping a data line to a target ramp voltage may induce a change in internal node voltage of a display pixel that facilitates offsetting an internal node voltage change resulting from leakage current.

In fact, in some embodiments, a target voltage pattern (e.g., target voltage ramp pattern and/or target hold voltage) to be applied to a data line during an emission period of an image may be adaptively (e.g., dynamically and/or selectively) determined based on various factors, such as a target (e.g., expected) display duration of the image, a target refresh rate of the image, pixel configuration on a display panel to be used to display the image, and/or image content included in the image. For example, since the influence of leakage current on light emission may vary over time, different target voltage ramp patterns may be determined (e.g., selected) for different target display durations and, thus, different target refresh rates. Additionally or alternatively, since leakage current flowing through a data line may be dependent at least in part on the number of contributing display pixels, a target voltage pattern (e.g., target voltage ramp pattern and/or a target hold voltage) to be applied to a data line may be determined based at least in part on the number of display pixels coupled thereto. In fact, during an emission period, in some embodiments, a display driver may be implemented and/or operated to supply different target voltage patterns to different data lines, for example, when the data lines are coupled to differing number of display pixels.

However, at least in some instances, contribution of different display pixels to a combined (e.g., total) leakage current flowing through a data line may differ, for example, when image content displayed at the different display pixels and, thus, corresponding target internal node voltages differ. Since magnitude of electrical current is generally proportional to a voltage difference between which it flows, at least in some instances, different internal node voltages may result in differing voltage differences relative to the data line voltage and, thus, differing contributions to the combined leakage current flowing through the data line. As such, in some embodiments, a target voltage pattern to be applied to a data line during an emission period may be determined based at least in part on the target internal node voltages of the display pixels coupled thereto and, thus, image content to be displayed using the target internal node voltages.

To facilitate writing display pixels, in some embodiments, a data driver may include one or more power amplifiers coupled to the display pixels via corresponding data lines. Generally, a power amplifier may receive an input (e.g., voltage and/or current) signal and operate to amplify the input signal and output an amplified (e.g., voltage and/or current) signal. In other words, during non-emission (e.g., refresh or writing) periods, a power amplifier in the data driver may operate to amplify image data signals to generate amplified image data signals, which may then be supplied to the data lines to write corresponding display pixels.

In some embodiments, the data driver may be implemented and/or operated to supply target voltage patterns (e.g., target voltage ramp patterns and/or target hold voltages) to the data lines during emission (e.g., display) periods in an analogous manner. In other words, at least in such embodiments, the data driver may selectively switch between supplying an image data signal and a signal indicative of a target intermediate voltage (e.g., included in a target voltage ramp pattern) to its power amplifiers, for example, via one or more input multiplexers. However, operating a power amplifier generally consumes electrical power and, thus, may affect (e.g., reduce) operational efficiency of the data driver and, thus, an electronic device in which the data driver is deployed.

To facilitate improving operational efficiency, in some embodiments, a data driver may be implemented and/or operated to supply a target intermediate voltage directly from a power supply rail during an emission (e.g., display) period. For example, the data driver may supply the target intermediate voltage to a data line directly from an amplifier power supply rail, thereby bypassing its power amplifiers. In addition to an amplifier power supply rail, in some embodiments, a data driver may be coupled to one or more additional (e.g., secondary) power supply rails. For example, when voltage of the amplifier power supply rail differs from a target intermediate voltage, the data driver may be coupled to another power supply rail dedicated to supplying the target intermediate voltage. In other words, at least in such embodiments, a data driver may selectively switch between supplying an amplified signal output from its power amplifiers and a voltage provided by a power supply rail to the data lines, for example, via one or more output multiplexers. In this manner, the techniques of the present disclosure may facilitate stabilizing light emission from display pixels of an electronic display during display (e.g., emission period) of an image.

BRIEF DESCRIPTION OF THE DRAWINGS

Various aspects of the present disclosure may be better understood upon reading the following detailed description and upon reference to the drawings in which.

DETAILED DESCRIPTION

Figure 1:
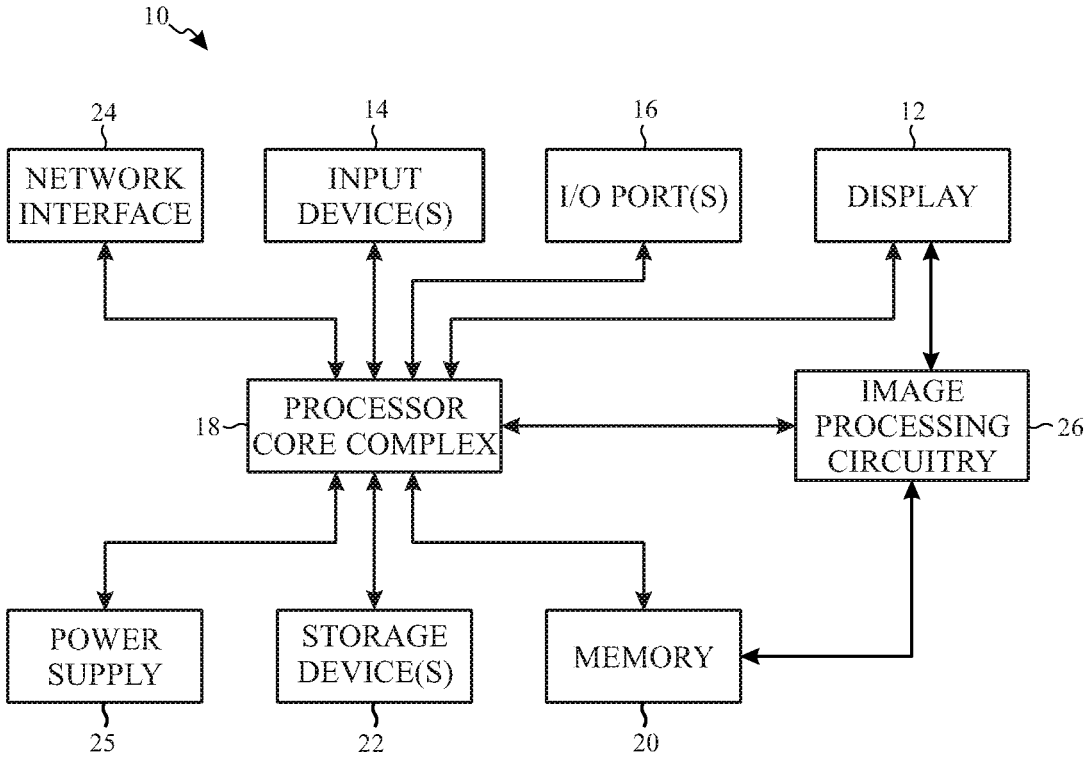
FIG. 1 is a block diagram of an electronic device including an electronic display, in accordance with an embodiment of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure generally relates to electronic displays, which may be used to present visual representations of information as one or more images (e.g., image frames and/or pictures). Accordingly, electronic devices, such as computers, mobile phones, portable media devices, tablets, televisions, virtual-reality headsets, and vehicle dashboards, among many others, often include and/or utilize one or more electronic displays. Generally, image data corresponding with an image to be display on an electronic display may indicate target characteristics of image content. For example, the image data may indicate target luminance (e.g., brightness or grayscale level) at various points (e.g., image pixels) in the image content. As such, to display an image, an electronic display may control light emission (e.g., luminance) from display pixels implemented on its display panel based at least in part on image data associated with corresponding image pixels.

Generally, light emission from a display pixel varies with the amount of electrical energy stored therein. For example, in some instances, a display pixel may include a light emissive element, such as an organic light-emitting diode (OLED), that varies its light emission with current flowing therethrough, a current control switching device (e.g., transistor) coupled between the light emissive element and a pixel power (e.g., $V_{DD}$) supply rail, and a storage capacitor coupled to a control (e.g., gate) terminal of the current control switching device at an internal node of the display pixel. As such, varying the amount of energy stored in the storage capacitor may vary voltage applied to the control input of the current control switching device and, thus, magnitude of electrical current supplied from the pixel power supply rail to the light emissive element. In other words, at least in such instances, light emission from a display pixel may be controlled at least in part by controlling magnitude of electrical power (e.g., voltage and/or current) supplied to its internal node.

It should be appreciated that the OLED examples described in the present disclosure are merely intended to be illustrative and not limiting. In particular, it should be appreciated that the techniques described in the present disclosure may be applied to and/or implemented in other types of electronic displays. For example, the techniques may be adapted to a liquid crystal display (LCD) that uses a pixel electrode and a common electrode as a storage capacitor.

To facilitate controlling magnitude of electrical power supplied to its display pixels, a display panel generally includes a scan driver coupled to groups (e.g., rows) of display pixels via corresponding scan lines and a data driver coupled to groups (e.g., columns) of display pixels via corresponding data lines. Additionally, a display pixel may include one or more scan control switching devices (e.g., transistors) coupled between its internal node and a corresponding data line. In other words, to write the display pixel, the one or more scan control switching devices may each be switched to and maintained in its connected (e.g., conductive or closed) state, thereby enabling the data line to adjust energy stored in its storage capacitor and, thus, resulting light emission, for example, by charging and/or discharging the storage capacitor.

Generally, an electronic display may alternate between non-emission (e.g., refresh or writing) periods during which images are written and emission (e.g., display) periods during which images are displayed based on electrical energy stored in its display pixels during a preceding non-emission period. In other words, before a subsequent emission period, one or more scan control switching devices (e.g., transistors) in a display pixel may each be switched to and maintained in its disconnected (e.g., non-conductive or open) state, thereby breaking (e.g., blocking) a direct (e.g., primary) electrical path between the internal node of the display pixel and a corresponding data line. However, at least in some instances, light emission from a display pixel may nevertheless vary during display of an image, for example, due to leakage current flowing through one or more of its switching devices, such as a scan control transistor and/or an emission control transistor, that are in the disconnected state. At least in some instances, changes in light emission during display of an image (e.g., relative to itself, a preceding image, and/or a subsequent image) may be perceivable as a visual artifact, such as a perceivable flicker, that affects (e.g., reduces) perceived quality of the image and, thus, potentially an electronic display that is displaying the image.

Accordingly, to facilitate improving perceived image quality, the present disclosure provides techniques for implementing and/or operating an electronic display to reduce likelihood and/or perceivability of visual artifacts, such as a flicker, resulting in displayed images, for example, by reducing the effect leakage current has on light emission of its display pixels. To facilitate reducing the effect of leakage current on light emission, in some embodiments, an electronic display may include a data driver implemented and/or operated to supply one or more intermediate voltages, which are each greater than a ground voltage, to data lines of the electronic display during an emission period of an image, for example, when a target (e.g., expected) display duration of the image is greater than a duration threshold and/or a target (e.g., expected) refresh rate of the image is less than a refresh rate threshold. In some embodiments, an intermediate voltage supplied to a data line may be a mid-range voltage, for example, halfway between a low-end voltage corresponding with a black grayscale level and a high-end voltage corresponding with a white grayscale level.

In other words, in some embodiments, a data driver may be implemented and/or operated to supply a non-zero voltage to a data line coupled thereto during display (e.g., emission period) of an image, for example, instead of constantly holding the data line at a ground (e.g., zero) voltage. As such, at least in some embodiments, supplying an intermediate voltage to a data line may facilitate reducing the voltage difference between the data line and an internal node voltage of a display pixel coupled to the data line. Since magnitude of electrical current is generally proportional to a voltage difference between which it flows, in some embodiments, supplying the intermediate voltage to a data line may facilitate reducing magnitude of the voltage difference between the data line and the internal node of the display pixel and, thus, magnitude of leakage current flowing between the internal node and the data line. Additionally, since voltage of a capacitor generally varies with the amount of energy stored therein, at least in some embodiments, reducing the magnitude of the leakage current may facilitate reducing magnitude of a resulting change in the internal node voltage and, thus, a resulting change in light emission during display (e.g., emission period) of an image.

However, at least in some embodiments, some amount of leakage current may nevertheless occur and, thus, flow through a corresponding data line even when the data line is supplied an intermediate voltage during the emission period. Additionally, due to parasitic capacitance between a data line and electrical conductive material implemented in a display pixel, in some embodiments, electrical current flowing through the data line may result in electrical current flowing through an internal node of the display pixel even when one or more switching devices (e.g., transistors) coupled therebetween is each in its disconnected state. In fact, in some embodiments, a change in voltage over time (e.g., dv/dt) resulting from leakage current flowing through a data line may combine with the change in internal node voltage resulting from leakage current of a display pixel to produce a multi-order (e.g., second-order) response in the internal node voltage and, thus, resulting light emission from the display pixel.

For example, during a first (e.g., initial) portion of an emission period, a change in internal node voltage of a display pixel may primarily result from leakage current flowing from its storage capacitor through one or more closed state switching devices to a data line coupled thereto. As such, during the first portion of the emission period, the internal node voltage and, thus, resulting light emission from the display pixel may gradually decrease due its leakage current. However, the leakage current from the display pixel may combine with leakage current flowing from one or more other display pixel coupled to the same data line, thereby resulting in magnitude of total (e.g., combined) leakage current flowing through the data line and, thus, resulting data line voltage increasing over time.

When disposed in close proximity to one another, at least in some instances, changes in voltage over time of electrical current flowing through a data line may induce an electrical current in a display pixel that changes its internal node voltage, for example, by charging and/or discharging a storage capacitor coupled to its internal node. In other words, at least in some instances, the influence of the combined leakage current flowing through the data line on the internal node voltage of the display pixel generally increases during a second (e.g., later or subsequent) portion of the emission period. In fact, at least in some instances, the increased influence of the combined leakage current may result in the internal node voltage and, thus, resulting light emission from the display pixel varying non-monotonically during the second portion of the emission period, for example, such that the internal node voltage and, thus, result light emission gradually increasing before gradually decreasing.

To facilitate stabilizing a multi-order response, in some embodiments, a data driver may be implemented and/or operated to ramp a data line voltage to multiple intermediate voltages during an emission period. In other words, in some embodiments, the data driver may apply a voltage ramp pattern to a data line during the emission period, for example, instead of holding the data line constantly at a single intermediate voltage. As an illustrative example, during an emission period of an image, the data driver may ramp a data line voltage from a ground voltage to a first intermediate voltage at a first target ramp time, from the first intermediate voltage to a second intermediate voltage at a second target ramp time, and so on. In some embodiments, the change in voltage over time (e.g., dv/dt) resulting from ramping a data line to a target ramp voltage may induce a change in internal node voltage of a display pixel that facilitates offsetting an internal node voltage change resulting from leakage current flowing from the display pixel and/or an internal node voltage change induced by a combined leakage current flowing through the data line.

In addition to ramping a data line voltage to multiple intermediate voltages, in some embodiments, a voltage ramp pattern may additionally include holding the data line voltage at one or more of the intermediate voltages. To help illustrate, continuing with the above example, after ramping to the first intermediate voltage, the data driver may continue supplying the first intermediate voltage to the data line until the second ramp time is reached. As described above, in some embodiments, holding a data line voltage at an intermediate (e.g., mid-range) voltage may facilitate reducing the voltage difference between the data line voltage and the internal node voltages of display pixels coupled thereto, which, at least in some instances, may facilitate reducing the magnitude of leakage current and, thus, resulting effect on perceived image quality. In some embodiments, a data driver may be implemented and/or operated to apply other voltage ramp patterns, for example, which ramp down and/or which continuously change voltage.

In fact, in some embodiments, a target voltage pattern (e.g., target voltage ramp pattern and/or target hold voltage) to be applied to a data line during an emission period may be adaptively (e.g., dynamically and/or selectively) determined based on various factors, such as a target (e.g., expected) display duration of an image, a target refresh rate of the image, pixel configuration of a display panel to be used to display the image, and/or content of the image. In particular, since the influence of combined leakage current on internal node voltage generally increases with time, in some embodiments, different target voltage ramp patterns may be determined (e.g., selected) for different target display durations and, thus, different target refresh rates. For example, a target voltage ramp pattern selected for a shorter target display duration (e.g., higher target refresh rate) may include fewer voltage ramping steps, lower magnitude ramp voltages, shorter ramp durations, shorter hold durations, or any combination thereof. On the other hand, a target voltage ramp pattern selected for a longer target display duration (e.g., smaller target refresh rate), may include more voltage ramping steps, higher magnitude ramp voltages, longer ramp durations, longer hold durations, or any combination thereof.

Additionally, since display duration and refresh rate is generally the same for each display pixel displaying an image on a display panel, in some embodiments, a data driver may be implemented and/or operated to supply the same target voltage pattern (e.g., target voltage ramp pattern and/or target hold voltage) to each data line coupled thereto, for example, when the display pixels are organized on the display panel to provide a rectangular display area. However, in some embodiments, different data lines on a display panel may be coupled to differing number of display pixels, for example, when the display pixels are organized to provide a non-rectangular display area (e.g., curved/rounded corners and/or notch). Accordingly, at least in such embodiments, the magnitude of combined leakage current flowing through different data lines may also differ. For example, when more display pixels are coupled to a data line, the magnitude of the combined leakage current flowing through the data line may be higher, thereby resulting in a larger change in the internal node voltages of the display pixels. Conversely, when fewer display pixels are coupled to a data line, the magnitude of the combined leakage current flowing through the data line may be lower, thereby resulting in a smaller change in the internal node voltages of the display pixels.

As such, in some embodiments, a target voltage pattern (e.g., target voltage ramp pattern and/or a target hold voltage) to be applied to a data line may be determined based at least in part on the number of display pixels coupled to the data line. In fact, during an emission period, in some embodiments, a display driver may be implemented and/or operated to supply different target voltage patterns to different data lines, for example, when the data lines are coupled to differing numbers of display pixels. As an illustrative example, a target voltage ramp pattern selected for a data line coupled to fewer display pixels may include fewer voltage ramping steps, lower magnitude ramp voltages, shorter ramp durations, or any combination thereof. On the other hand, a target voltage ramp pattern selected for a data line coupled to more display pixels may include more voltage ramping steps, higher magnitude ramp voltages, longer ramp durations, or any combination thereof.

However, at least in some instances, contribution of different display pixels to a combined (e.g., total) leakage current flowing through a data line may differ. For example, to display a black grayscale level, the internal node voltage of a display pixel may be set below a threshold voltage of its current control switching device, thereby blocking current flow from the pixel power supply rail to its light emissive element and, thus, maintaining the light emissive element off. On the other hand, to display a non-black grayscale level, the internal node voltage of the display pixel may be set above the threshold voltage of its current control switching device, thereby enabling current flow from the pixel power supply rail to its light emissive element and, thus, turning the light emissive element on.

In other words, to display an image, in some embodiments, the target internal node voltage of different display pixels coupled to a data line may differ. Since magnitude of electrical current is generally proportional to a voltage difference between which it flows, at least in some embodiments, different internal node voltages may result in different voltage differences relative to the voltage of a data line and, thus, differing contributions to a combined leakage current flowing through the data line. As such, in some embodiments, a target voltage pattern to be applied to a data line during an emission period may be determined based at least in part on the target internal node voltages of display pixels coupled thereto and, thus, image content to be displayed using the target internal node voltages. In other words, in some embodiments, different target voltage patterns (e.g., target voltage ramp patterns and/or target hold voltages) may be selected (e.g., determined) for different images and/or for different data lines based at least in part on corresponding image content.

Generally, to facilitate writing display pixels, a data driver may include one or more power amplifiers coupled to the data lines. For example, the data driver may include multiple power amplifiers each coupled to a corresponding data line. To facilitate writing image data to a corresponding display pixel during a non-emission period, a power amplifier may amplify the image data before supply to the display pixel via a corresponding data line as a data line voltage signal. To facilitate amplification, in some embodiments, the power amplifiers may receive electrical power from a power supply, for example, via an amplifier power supply rail.

In some embodiments, a data driver may be implemented and/or operated to supply a target voltage pattern (e.g., target voltage ramp pattern and/or a hold voltage) during an emission period in an analogous manner. In other words, at least in such embodiments, the data driver may selectively switch between supplying image data and a target intermediate voltage (e.g., included in a target voltage ramp pattern) to its power amplifiers, for example, via one or more input multiplexers. However, operating a power amplifier generally consumes electrical power. Moreover, since a power amplifier is generally less than 100% efficient, operating a power amplifier during emission periods may affect (e.g., reduce) operational efficiency of a data driver and, thus, an electronic device in which the data driver is deployed.

To facilitate improving operational efficiency, in some embodiments, a data driver may be implemented and/or operated to supply a target intermediate voltage directly from a power supply rail during an emission period. For example, the data driver may supply the target intermediate voltage to a data line directly from its amplifier power supply rail, thereby bypassing its power amplifiers. In addition to an amplifier power supply rail, in some embodiments, a data driver may be coupled to one or more additional (e.g., secondary) power supply rails. For example, when voltage of the amplifier power supply rail differs from a target intermediate voltage, the data driver may be coupled to another power supply rail dedicated to supplying electrical power with the target intermediate voltage. In other words, at least in such embodiments, a data driver may selectively switch between supplying a voltage signal output from its power amplifiers and a voltage provided by a power supply rail to the data lines, for example, via one or more output multiplexers.

To facilitate producing a voltage ramp pattern that includes more than one intermediate voltage, in some embodiments, a data driver may be coupled to multiple power supply rails that each supplies electrical power with a different voltage. For example, the data driver may be coupled to a first power supply rail that supplies a first intermediate voltage, a second power supply rail that supplies a second intermediate voltage, and so on. To produce a target voltage ramp pattern, the data driver may selectively connect different power supply rails to a data line at different times during an emission period. For example, the data driver connect the first power supply rail at a first target ramp time to ramp the data line voltage from a ground voltage to the first intermediate voltage, connect the second power supply rail at a second target ramp time to ramp the data line voltage from the first intermediate voltage to the second intermediate voltage, and so on.

In this manner, the techniques of the present disclosure may facilitate stabilizing light emission from display pixels of an electronic display during display (e.g., emission period) of an image. In particular, in some embodiments, a data driver may be implemented and/or operated to supply an intermediate voltage, which is greater than a ground voltage, to a data line during the emission period of an image to facilitate reducing voltage difference between the data line and internal nodes of one or more display pixels coupled to the data line and, thus, magnitude of individual leakage current of the display pixels and/or magnitude of combined (e.g., total) leakage current flowing through the data line. Additionally or alternatively, the data driver may be implemented and/or operated to ramp to the intermediate voltage during the emission period to facilitate producing a change in data line voltage over time, which induces a change in internal node voltage of a display pixel that is expected to offset an internal node voltage change resulting from its own (e.g., individual) leakage current and/or an internal node voltage change induced by a combined leakage current flowing through the data line. As such, at least in some instances, implementing and/or operating a data driver in this manner may facilitate improving perceived of quality of a displayed image and, thus, potentially an electronic display that is displaying the image, for example, by reducing likelihood and/or perceivability of visual artifacts, such as a perceivable flicker, resulting in the image.

To help illustrate, an example of an electronic device 10, which utilizes an electronic display 12, is shown in FIG. 1. As will be described in more detail below, the electronic device 10 may be any suitable electronic device, such as a computer, a mobile (e.g., portable) phone, a portable media device, a tablet device, a television, a handheld game platform, a personal data organizer, a virtual-reality headset, a mixed-reality headset, a vehicle dashboard, and/or the like. Thus, it should be noted that FIG. 1 is merely one example of a particular implementation and is intended to illustrate the types of components that may be present in an electronic device 10.

In addition to the electronic display 12, as depicted, the electronic device 10 includes one or more input devices 14, one or more input/output (I/O) ports 16, a processor core complex 18 having one or more processors or processor cores, memory 20, one or more storage devices 22, a network interface 24, a power supply 25, and image processing circuitry 26. The various components described in FIG. 1 may include hardware elements (e.g., circuitry), software elements (e.g., a tangible, non-transitory computer-readable medium storing instructions), or a combination of both hardware and software elements. It should be noted that the various depicted components may be combined into fewer components or separated into additional components. For example, the memory 20 and a storage device 22 may be included in a single component. Additionally or alternatively, the image processing circuitry 26 may be included in the processor core complex 18 or the electronic display 12.

As depicted, the processor core complex 18 is operably coupled with memory 20 and the storage device 22. As such, in some embodiments, the processor core complex 18 may execute instructions stored in memory 20 and/or a storage device 22 to perform operations, such as generating image data. Additionally or alternatively, the processor core complex 18 may operate based on circuit connections formed therein. As such, in some embodiments, the processor core complex 18 may include one or more general purpose microprocessors, one or more application specific processors (ASICs), one or more field programmable logic arrays (FPGAs), or any combination thereof.

In addition to instructions, in some embodiments, the memory 20 and/or the storage device 22 may store data, such as image data. Thus, in some embodiments, the memory 20 and/or the storage device 22 may include one or more tangible, non-transitory, computer-readable media that store instructions executable by processing circuitry, such as the processor core complex 18 and/or the image processing circuitry 26, and/or data to be processed by the processing circuitry. For example, the memory 20 may include random access memory (RAM) and the storage device 22 may include read only memory (ROM), rewritable non-volatile memory, such as flash memory, hard drives, optical discs, and/or the like.

As depicted, the processor core complex 18 is also operably coupled with the network interface 24. In some embodiments, the network interface 24 may enable the electronic device 10 to communicate with a communication network and/or another electronic device 10. For example, the network interface 24 may connect the electronic device 10 to a personal area network (PAN), such as a Bluetooth network, a local area network (LAN), such as an 802.11x Wi-Fi network, and/or a wide area network (WAN), such as a 4G or LTE cellular network. In other words, in some embodiments, the network interface 24 may enable the electronic device 10 to transmit data (e.g., image data) to a communication network and/or receive data from the communication network.

Additionally, as depicted, the processor core complex 18 is operably coupled to the power supply 25. In some embodiments, the power supply 25 may provide electrical power to operate the processor core complex 18 and/or other components in the electronic device 10, for example, via one or more power supply rails. Thus, the power supply 25 may include any suitable source of electrical power, such as a rechargeable lithium polymer (Li-poly) battery and/or an alternating current (AC) power converter.

Furthermore, as depicted, the processor core complex 18 is operably coupled with one or more I/O ports 16. In some embodiments, an I/O ports 16 may enable the electronic device 10 to interface with another electronic device 10. For example, a portable storage device may be connected to an I/O port 16, thereby enabling the electronic device 10 to communicate data, such as image data, with the portable storage device.

As depicted, the processor core complex 18 is also operably coupled with one or more input devices 14. In some embodiments, an input device 14 may enable a user to interact with the electronic device 10. For example, the input devices 14 may include one or more buttons, one or more keyboards, one or more mice, one or more trackpads, and/or the like. Additionally, in some embodiments, the input devices 14 may include touch sensing components implemented in the electronic display 12. In such embodiments, the touch sensing components may receive user inputs by detecting occurrence and/or position of an object contacting the display surface of the electronic display 12.

In addition to enabling user inputs, the electronic display 12 may facilitate providing visual representations of information by displaying one or more images (e.g., image frames or pictures). For example, the electronic display 12 may display a graphical user interface (GUI) of an operating system, an application interface, text, a still image, or video content. To facilitate displaying images, the electronic display 12 may include a display panel with one or more display pixels. Additionally, in some embodiments, each display pixel may include one or more sub-pixels, which each control luminance of one color component (e.g., red, blue, or green).

As described above, the electronic display 12 may display an image by controlling luminance of its display pixels based at least in part image data associated with corresponding image pixels (e.g., points) in the image. In some embodiments, image data may be generated by an image source, such as the processor core complex 18, a graphics processing unit (GPU), and/or an image sensor. Additionally, in some embodiments, image data may be received from another electronic device 10, for example, via the network interface 24 and/or an I/O port 16. In any case, as described above, the electronic device 10 may be any suitable electronic device.

Figure 2:
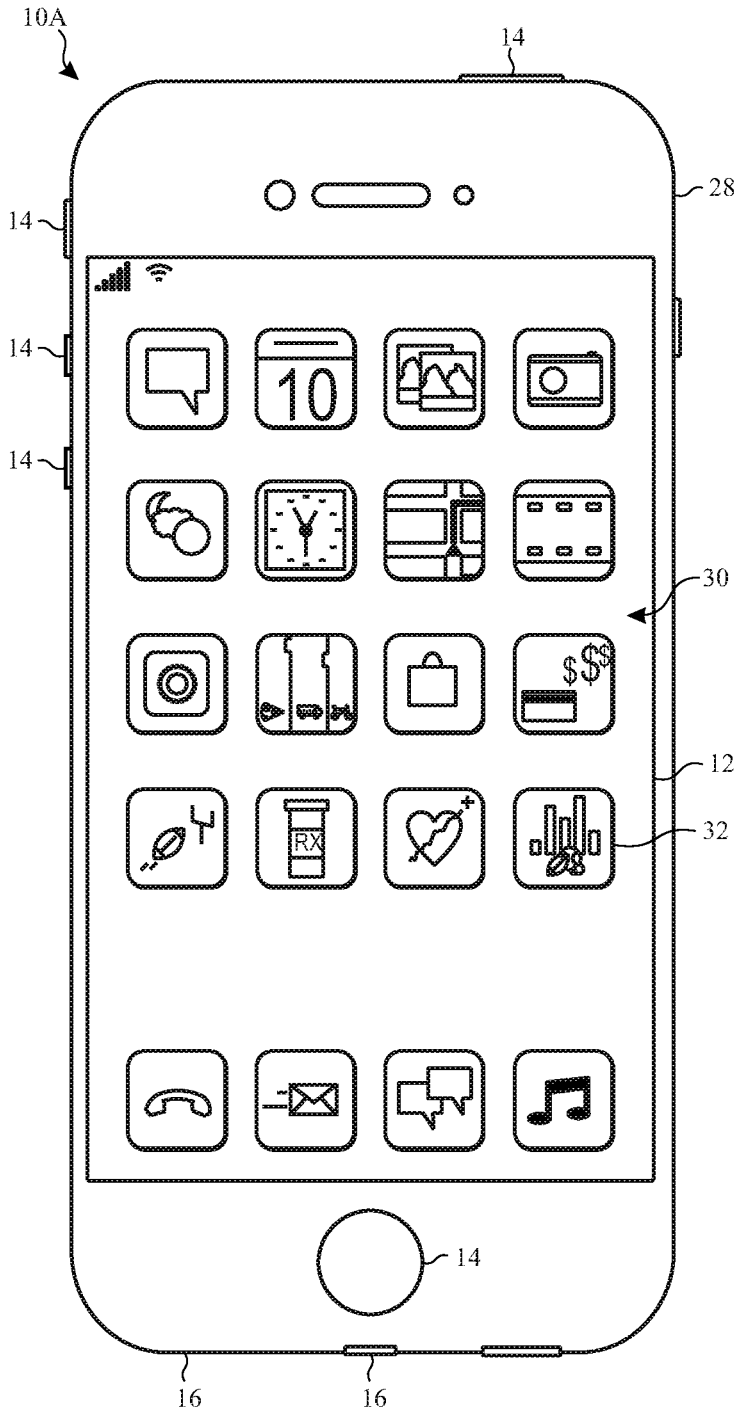
FIG. 2 is an example of the electronic device of FIG. 1, in accordance with an embodiment of the present disclosure.

To help illustrate, one example of a suitable electronic device 10, specifically a handheld device 10A, is shown in FIG. 2. In some embodiments, the handheld device 10A may be a portable phone, a media player, a personal data organizer, a handheld game platform, and/or the like. For example, the handheld device 10A may be a smart phone, such as any iPhone® model available from Apple Inc.

As depicted, the handheld device 10A includes an enclosure 28 (e.g., housing). In some embodiments, the enclosure 28 may protect interior components from physical damage and/or shield them from electromagnetic interference. Additionally, as depicted, the enclosure 28 surrounds the electronic display 12. In the depicted embodiment, the electronic display 12 is displaying a graphical user interface (GUI) 30 having an array of icons 32. By way of example, when an icon 32 is selected either by an input device 14 or a touch sensing component of the electronic display 12, an application program may launch.

Furthermore, as depicted, input devices 14 open through the enclosure 28. As described above, the input devices 14 may enable a user to interact with the handheld device 10A. For example, the input devices 14 may enable the user to activate or deactivate the handheld device 10A, navigate a user interface to a home screen, navigate a user interface to a user-configurable application screen, activate a voice-recognition feature, provide volume control, and/or toggle between vibrate and ring modes. As depicted, the I/O ports 16 also open through the enclosure 28. In some embodiments, the I/O ports 16 may include, for example, an audio jack to connect to external devices.

Figure 3:
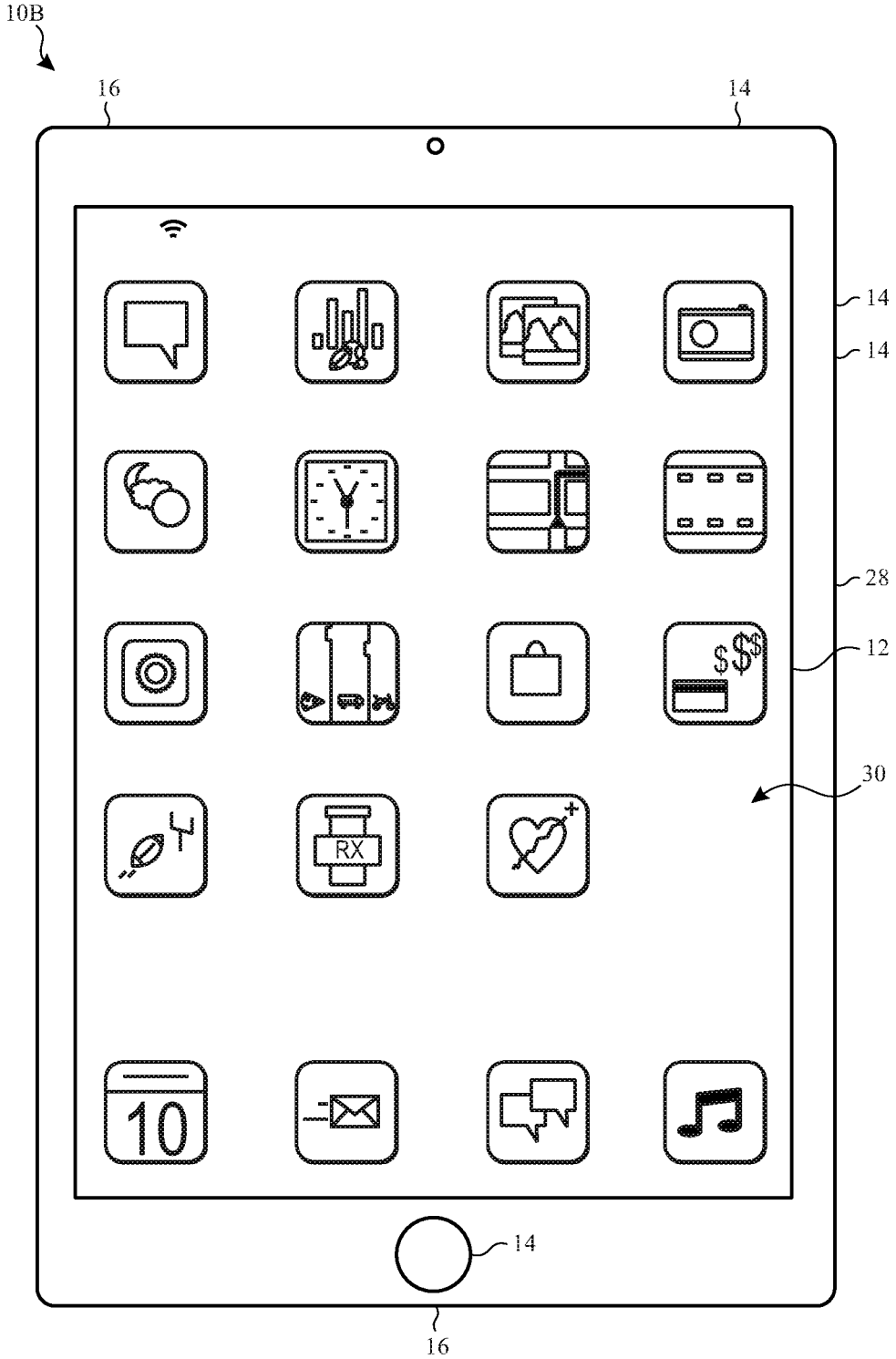
FIG. 3 is another example of the electronic device of FIG. 1, in accordance with an embodiment of the present disclosure.
Figure 4:
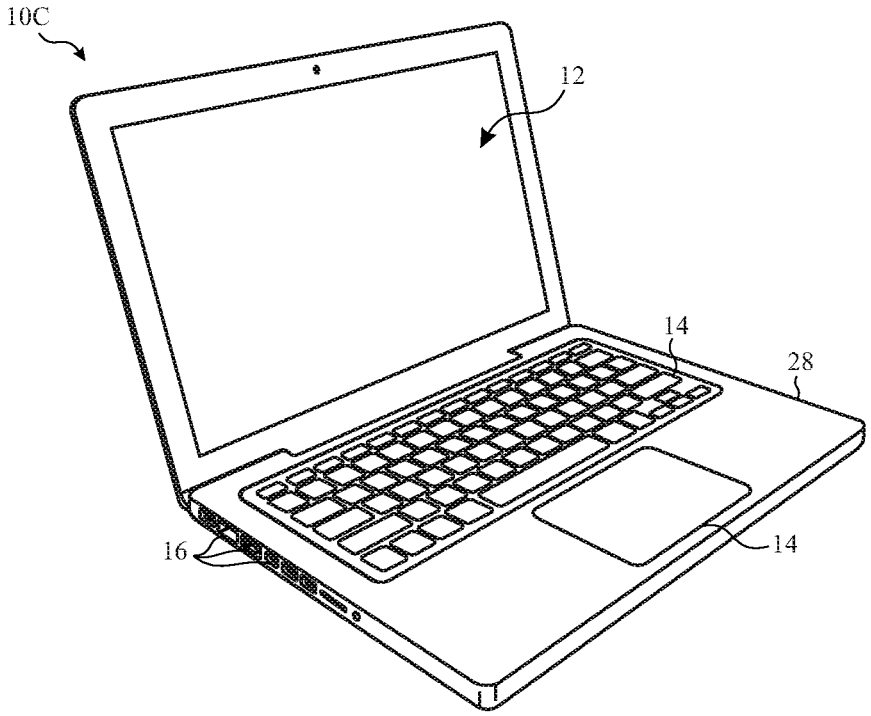
FIG. 4 is another example of the electronic device of FIG. 1, in accordance with an embodiment of the present disclosure.
Figure 5:
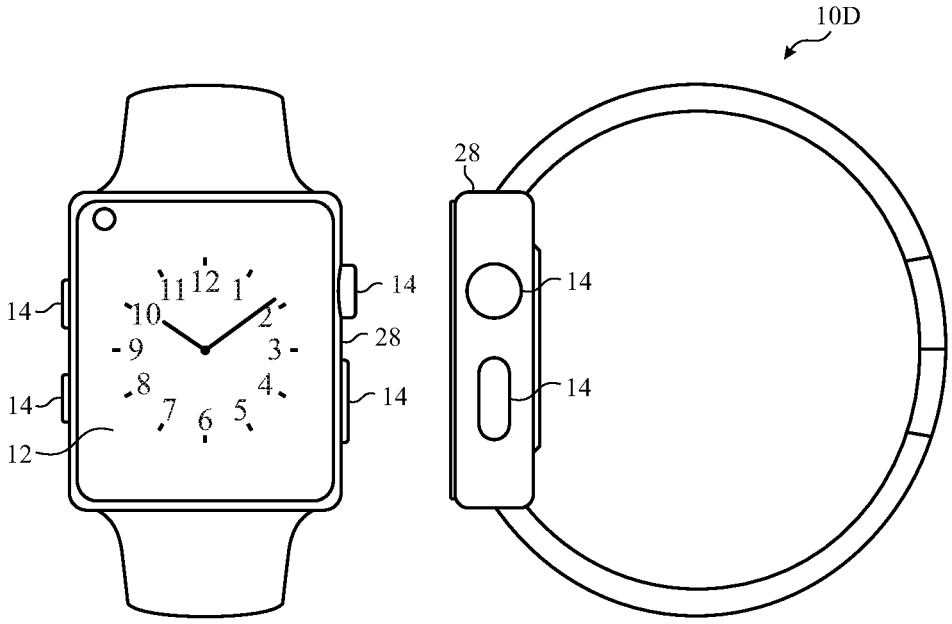
FIG. 5 is another example of the electronic device of FIG. 1, in accordance with an embodiment of the present disclosure.

To help further illustrate, another example of a suitable electronic device 10, specifically a tablet device 10B, is shown in FIG. 3. For illustrative purposes, the tablet device 10B may be any iPad® model available from Apple Inc. A further example of a suitable electronic device 10, specifically a computer 10C, is shown in FIG. 4. For illustrative purposes, the computer 10C may be any Macbook® or iMac® model available from Apple Inc. Another example of a suitable electronic device 10, specifically a watch 10D, is shown in FIG. 5. For illustrative purposes, the watch 10D may be any Apple Watch® model available from Apple Inc. As depicted, the tablet device 10B, the computer 10C, and the watch 10D each also includes an electronic display 12, input devices 14, I/O ports 16, and an enclosure 28. In any case, as described above, an electronic display 12 may generally display images based at least in part on image data, for example, output from the processor core complex 18 and/or the image processing circuitry 26.

Figure 6:
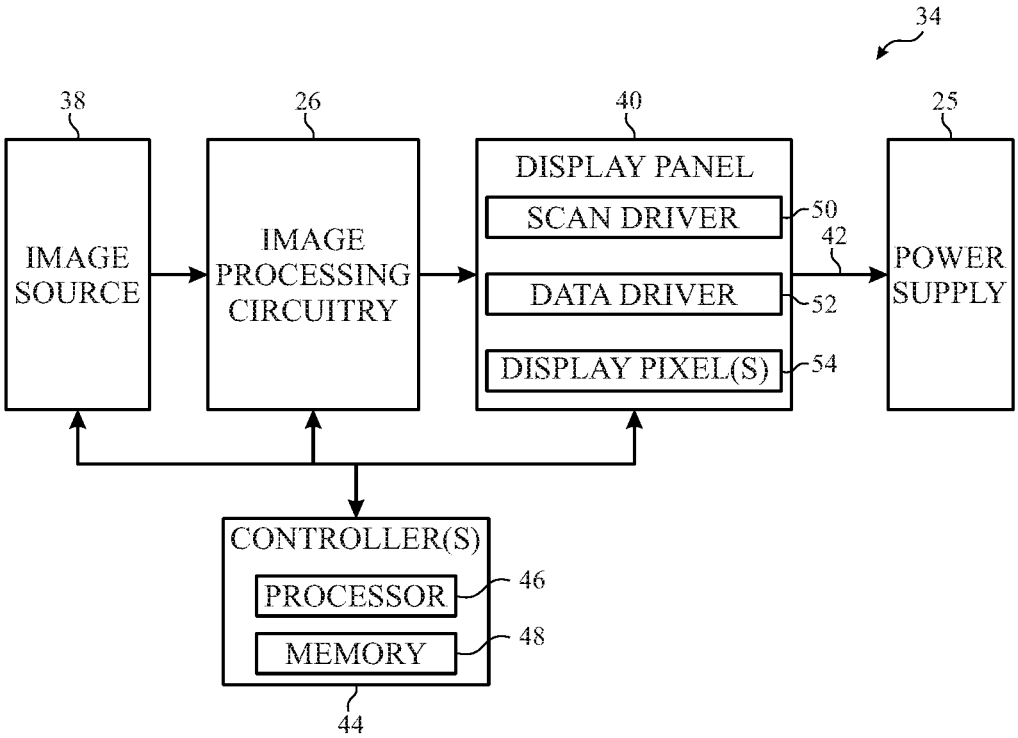
FIG. 6 is a block diagram of an example portion of the electronic device of FIG. 1 including a display panel, in accordance with an embodiment of the present disclosure.

To help illustrate, an example of a portion 34 of an electronic device 10, which includes an image source 38 and a display panel 40 of an electronic display 12, is shown in FIG. 6. Generally, the image source 38 may be implemented and/or operated to generate image data corresponding with an image to be displayed on the display panel 40. Thus, in some embodiments, the image source 38 may be a processor core complex 18, a graphics processing unit (GPU), an image sensor (e.g., camera), and/or the like.

Additionally, as in the depicted example, the portion of the electronic device 10 may include image processing circuitry 26 coupled between the image source 38 and the display panel 40, a power supply 25 coupled to the display panel 40 via one or more power supply rails 42, and a controller (e.g., control circuitry and/or control logic) 44. In some embodiments, the controller 44 may generally control operation of image source 38, the image processing circuitry 26, and/or the display panel 40. Although depicted as a single controller 44, in other embodiments, one or more separate controllers 44 may be used to control operation of the image source 38, the image processing circuitry 26, the display panel 40, or any combination thereof.

To facilitate controlling operation, as in the depicted example, the controller 44 may include a controller processor 46 and controller memory 48. In some embodiments, the controller processor 46 may execute instructions and/or process data stored in the controller memory 48 to control operation of the image source 38, the image processing circuitry 26, and/or the display panel 40. In other embodiments, the controller processor 46 may be hardwired with instructions that control operation of the image source 38, the image processing circuitry 26, and/or the display panel 40 when executed. Additionally, in some embodiments, the controller processor 46 may be included in the processor core complex 18 and/or separate processing circuitry and the controller memory 48 may be included in main memory 20, a storage device 22, and/or a separate, tangible, non-transitory computer-readable medium.

To facilitate improving perceived image quality, in some embodiments, the image processing circuitry 26 may be implemented and/or operated to process image data output from the image source 38 before the image data is used to display a corresponding image on the display panel 40. For example, the image processing circuitry 26 may process image data received from the image source 38 to adjust target luminance (e.g., greyscale level) indicated by the image data based at least in part on ambient lighting conditions, a sub-pixel layout, panel burn-in, expected panel response, or any combination thereof. Thus, in some embodiments, the image processing circuitry 26 may be included in the processor core complex 18, a display pipeline, a timing controller (TCON) in the electronic display 12, or any combination thereof. Additionally or alternatively, the image processing circuitry 26 may be implemented as a system-on-chip (SoC).

However, it should be appreciated that the depicted example is merely intended to be illustrative and not limiting. For example, in some embodiments, the image processing circuitry 26 may be optional and, thus, not included in an electronic device 10. In other words, at least in such embodiments, image data generated by the image source 38 may be directly used to display a corresponding image on the display panel 40.

To facilitate displaying images, as in the depicted example, the display panel 40 may include a scan driver 50, a data driver 52, and one or more display pixels (e.g., sub-pixels) 54. As described above, image data corresponding with an image may indicate target grayscale (e.g., luminance or brightness) levels of one or more image pixels (e.g., points) in the image. Thus, based on received image data, the scan driver 50 and the data driver 52 may coordinate to selectively supply analog electrical (e.g., voltage and/or current) signals to the display pixels 54 to control light emission and, thus, perceived luminance of the display pixels 54.

Figure 7:
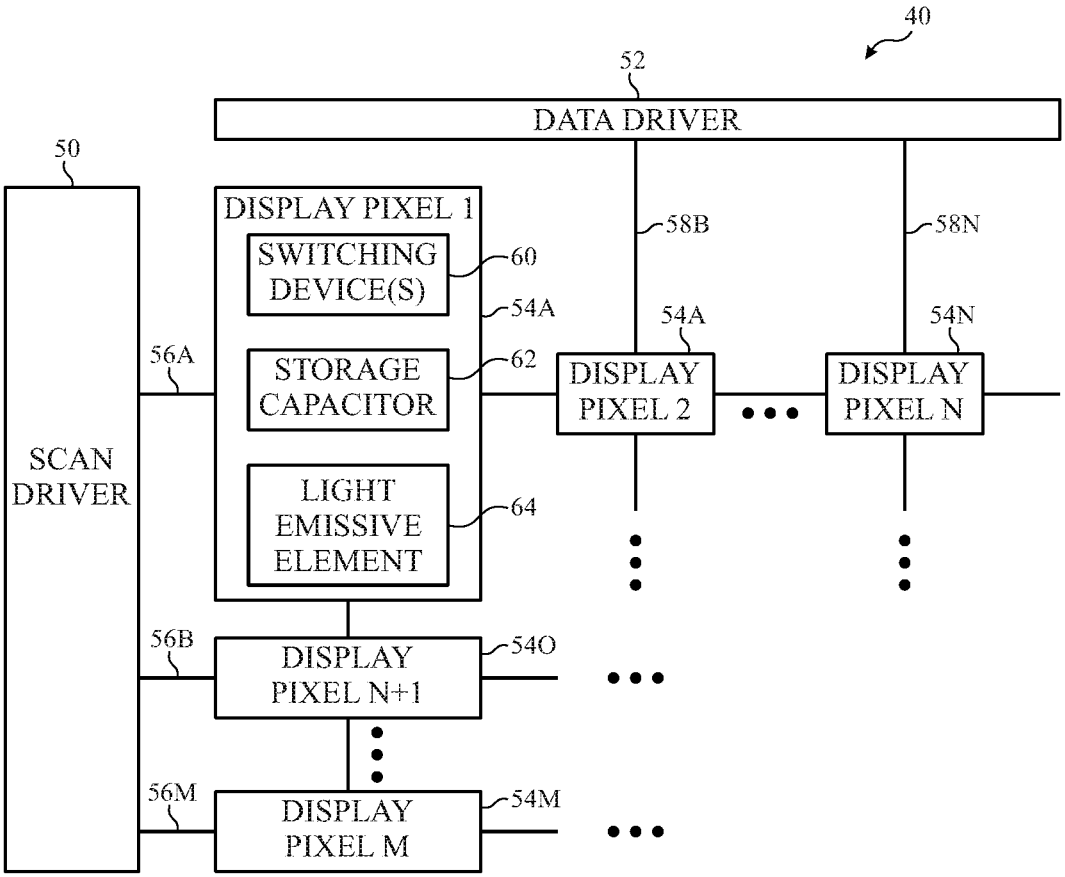
FIG. 7 is a block diagram of an example of the display panel of FIG. 6 including a data driver, a scan driver, and multiple display pixels, in accordance with an embodiment of the present disclosure.

To help further illustrate, an example of a display panel 40A, which includes display pixels 54 coupled to a scan driver 50 and a data driver 52, is shown in FIG. 7. As in the depicted example, the scan driver 50 is coupled to scan lines 56 implemented in a first (e.g., horizontal or row) direction and the data driver 52 is coupled to data lines 58 implemented in a second (e.g., different, vertical, or column) direction. Additionally, as in the depicted example, display pixels 54 may be implemented at the intersections of the scan lines 56 and the data lines 58.

For example, a first display pixel 54A may be implemented at an intersection of a first scan line 56A and a first data line 58A, a second display pixel 54B may be implemented at an intersection of the first scan line 56A and a second data line 58B, and an Nth display pixel 54N may be implemented at an intersection of the first scan line 56A and an Nth data line 58N. Similarly, an N+1th display pixel 54O may be implemented at an intersection of a second scan line 56B and the first data line 58A, an Mth display pixel 54M may be implemented at an intersection of an Mth scan line and the first data line 58A, and so on. In other words, in some embodiments, groups (e.g., columns) of display pixels 54 may each be coupled to the data driver 52 via a corresponding data line 58 and different groups (e.g., rows) of display pixels 54 may each be coupled to the scan driver 50 via a corresponding scan line 56.

Additionally, as in the depicted example, a display pixel 54 may include one or more switching devices 60, a storage capacitor 62, and a light emissive element 64. In some embodiments, one or more of the switching devices 60 may be implemented using a transistor, such as a thin film transistor (TFTs), a complementary metal oxide semiconductor (CMOS) transistor, a metal oxide semiconductor field effect transistor (MOSFET), a bipolar junction transistor (BJT), or the like. Additionally or alternatively, one or more of the switching devices 60 may implemented using a p-type metal-oxide-semiconductor (PMOS) transistor or an n-type metal-oxide-semiconductor (NMOS) transistor. Furthermore, in some embodiments, the light emissive element 64 may include an organic light-emitting diode (OLED), a micro light-emitting diode, and/or the like.

However, it should be appreciated that the depicted example is merely intended to illustrative and not limiting. For example, in another (e.g., LCD) display panel 40, the storage capacitor 62 in a display pixel 54 may be implemented by a pixel electrode and a common electrode shared with one or more other display pixels 54. Additionally or alternatively, in another (e.g., LCD) display panel 40, the light emissive element 64 in a display pixel 54 may be implemented by a liquid crystal layer disposed over a light emissive element 64 (e.g., backlight) shared with one or more other display pixels 54.

As described above, light emission and, thus, perceived luminance of a display pixel 54 is generally controlled by the amount of electrical energy stored in its storage capacitor 62. For example, storing more electrical energy in the storage capacitor 62 of the display pixel 54 during a non-emission (e.g., refresh or writing) period may result in higher magnitude electrical current being supplied to the light emissive element 64 of the display pixel 54 during a following emission period, thereby resulting in more light emission from the display pixel 54. Conversely, storing less electrical energy in the storage capacitor 62 of the display pixel 54 during the non-emission period may result in lower magnitude electrical current being supplied to the light emissive element 64 of the display pixel 54 during a following emission period, thereby resulting in less light emission from the display pixel 54.

In other words, in some embodiments, the display panel 40 may write a display pixel 54 during a non-emission period by controlling the amount of electrical energy stored in the display pixel 54. To facilitate controlling the amount of electrical energy stored in a display pixel 54 during a non-emission period, the data driver 52 may supply a data line voltage signal to a data line 58 coupled to the display pixel 54, for example, based on corresponding image data. However, since multiple display pixels 54 may be coupled to the same data line 58, in some embodiments, the display panel 40 may selectively (e.g., successively) write different groups (e.g., rows) of display pixels 54. To facilitate selectively writing a display pixel 54, the scan driver 50 may supply a scan control signal to a corresponding scan line 56 that results in one or more of its switching devices 60 switching to and maintaining a connected (e.g., closed) state, thereby providing a direct electrical path between its storage capacitor 62 and a corresponding data line 58, for example, to enable a data line voltage signal being supplied by the data driver 52 to the data line 58 to charge and/or discharge the storage capacitor 62 via the direct electrical path.

Figure 8:
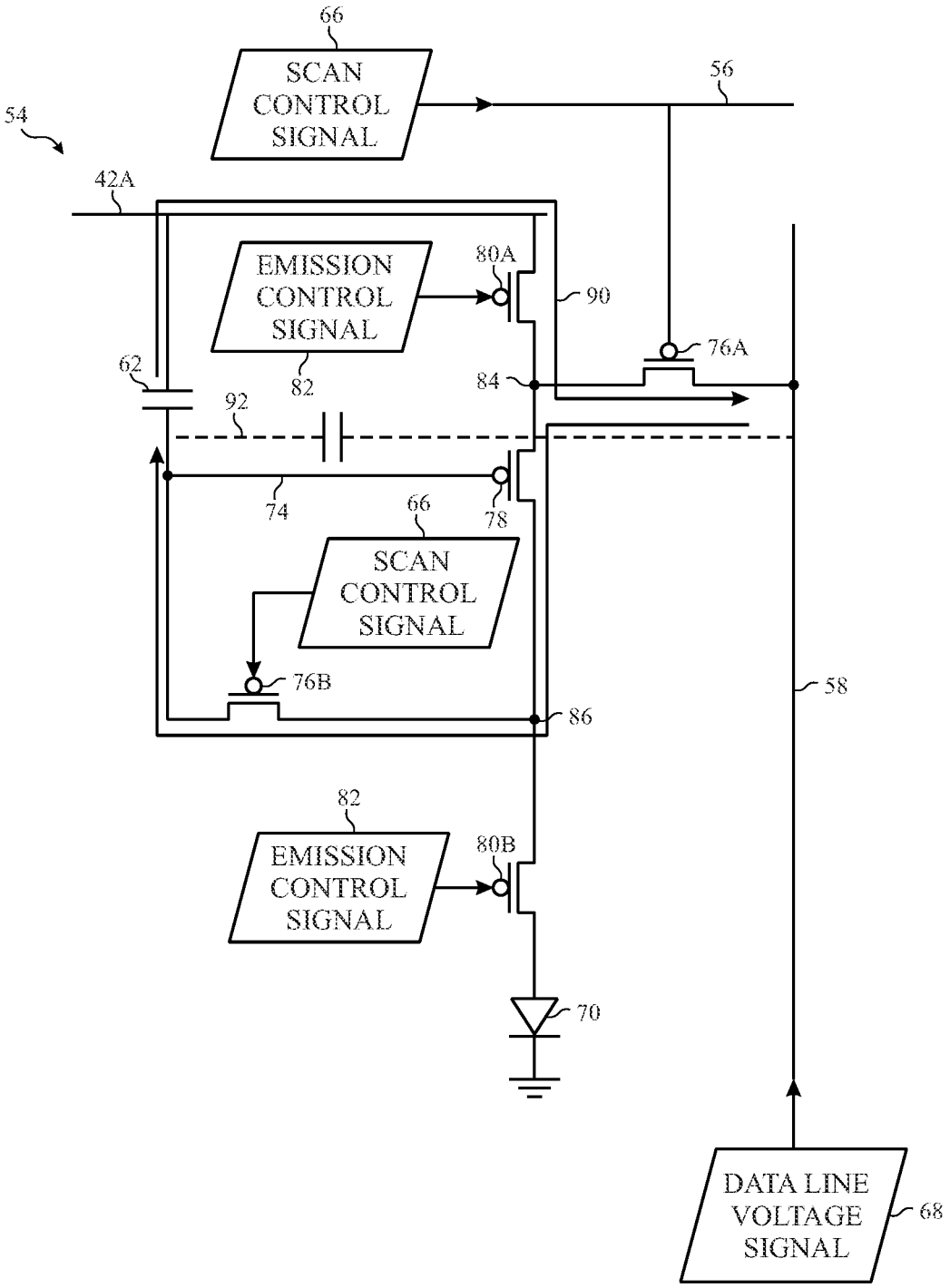
FIG. 8 is a circuit diagram of an example of a display pixel of FIG. 7, in accordance with an embodiment of the present disclosure.

To help further illustrate, an example of display pixel 54, which is coupled to a scan line 56 and a data line 58, is shown in FIG. 8. As in the depicted example, a scan control signal 66 may be supplied to the scan line 56, for example, by a scan driver 50. Additionally, as in the depicted example, a data line voltage signal 68 may be supplied to the data line 58, for example, by a data driver 52.

Furthermore, as described above, a display pixel 54 may include one or more switching devices 60, a storage capacitor 62, and a light emissive element 64, such as a (e.g., organic or micro) light-emitting diode 70. As in the depicted example, the storage capacitor 62 may be coupled between a pixel power supply rail 42A (e.g., $V_{DD}$) and an internal (e.g., current control) node 74 of the display pixel 54. Additionally, as in the depicted example, the one or more switching devices 60 may include one or more scan control transistors 76, a current control transistor 78, and one or more emission control transistors 80 that may each be supplied an emission control signal 82, for example, output from a scan driver 50 and/or a data driver 52.

However, it should be appreciated that the depicted example is merely intended to be illustrative and not limiting. For example, although described as p-type metal-oxide-semiconductor (PMOS) transistors, one or more switching devices 60 in a display pixel 54 may alternatively be implemented using an n-type metal-oxide-semiconductor (NMOS) transistor. Additionally or alternatively, a display pixel 54 may include fewer than five switching devices 60 or more than five switching devices 60. For example, in a 7T1C embodiment, a display pixel 54 may additionally include an initialization switching device (e.g., transistor) 60 coupled to the internal node 74 of the display pixel and another scan control transistor 76 coupled on one side to the light-emitting diode 70 and on the other side to the initialization switching device 60. On the other hand, in a 2T1C embodiment, a display pixel 54 may include a current control transistor 78 and a single scan control transistor 76, for example, obviating one or more additional scan control transistors 76 and/or one or more emission control transistors 80.

With regard to the depicted example, a control (e.g., gate) terminal of the current control transistor 78 may be coupled to the internal node 74 of the display pixel 54. Additionally, as in the depicted example, the current control transistor 78 may be coupled between a first node 84 and a second node 86, for example, such that its source terminal is coupled to the first node 84 and its drain terminal is coupled to the second node 86. As described above, in some embodiments, light emission from the display pixel 54 may vary based on the magnitude of electrical current supplied to its light-emitting diode 70. Thus, to facilitate controlling light emission, at least in such embodiments, the current control transistor 78 may be implemented to operate in its linear mode (e.g., region), for example, such that is channel width and, thus, permitted current flow varies proportionally with voltage of the internal node 74.

Additionally, as in the depicted example, a first emission control transistor 80A may be coupled between the pixel power supply rail 42A and the first node 84, for example, such that its source terminal is coupled to the pixel power supply rail 42A and its drain terminal is coupled to the first node 84 and, thus, the current control transistor 78. In some embodiments, the first emission control transistor 80A may be implemented and/or operated to selectively switch between its cutoff mode (e.g., disconnected state), which attempts to block flow of electrical power (e.g., current and/or voltage) between the pixel power supply rail 42A and first node 84, and its active (e.g., saturation) mode (e.g., connected state), which enables current flow from the pixel power supply rail 42A to the first node 84 and, thus, the current control transistor 78, for example, in response to a logic high emission control signal 82 and a logic low emission control signal 82, respectively. Furthermore, as in the depicted example, a second emission control transistor 80B may be coupled between the second node 86 and the light-emitting diode 70, for example, such that its drain terminal is coupled to the light-emitting diode 70 and its source terminal is coupled to the second node 86 and, thus, the current control transistor 78. In some embodiments, the second emission control transistor 80B may be implemented and/or operated to selectively switch between its cutoff mode (e.g., disconnected state), which blocks current flow from the second node 86 and, thus, the current control transistor 78 to the light-emitting diode 70, and its active mode (e.g., connected state), which enables current flow from the second node 86 and, thus, the current control transistor 78 to the light-emitting diode 70, for example, in response to a logic high emission control signal 82 and a logic low emission control signal 82, respectively.

In other words, during an emission (e.g., display) period, the emission control signal 82 may instruct the emission control transistors 80 to each switch to and maintain its connected (e.g., conductive and/or closed) state, thereby enabling the channel width of the current control transistor 78 resulting from the voltage the internal node 74 to control magnitude of electrical current supplied from the pixel power supply rail 42A to the light-emitting diode 70 and, thus, light emission from the display pixel 54. On the other hand, during a non-emission (e.g., refresh or writing) period, the emission control signal 82 may instruct the emission control transistors 80 to each switch to and maintain its disconnected (e.g., non-conductive or open) state, thereby blocking current flow through the light-emitting diode 70. As described above, in some embodiments, a display panel 40 may write a display pixel 54 during a non-emission period, for example, using a data line voltage signal 68 generated based on a target grayscale level indicated in corresponding image data.

To facilitate selectively writing the display pixel 54, as in the depicted example, a first scan control transistor 76A may be coupled between the data line 58 and the first node 84. In some embodiments, the first scan control transistor 76A may be implemented and/or operated to selectively switch between its cutoff mode (e.g., disconnected state), which attempts to block flow of electrical power between the data line 58 and the first node 84, and its active (e.g., saturation) mode (e.g., connected state), which enables flow of electrical power between the data line 58 and the first node 84, for example, in response to a logic high scan control signal 66 and a logic low scan control signal 66, respectively. Additionally, as in the depicted example, a second scan control switching device 76B may be coupled between the internal node 74 of the display pixel 54 and the second node 86. In some embodiments, the second scan control transistor 76B may be implemented and/or operated to selectively switch between its cutoff mode (e.g., disconnected state), which attempts to blocks flow of electrical power between the second node 86 and the internal node 74 of the display pixel 54, and its active mode (e.g., connected state), which enables flow of electrical power between the second node 86 and the internal node 74 of the display pixel 54, for example, in response to a logic high scan control signal 66 and a logic low scan control signal 66, respectively.

In other words, during a non-emission (e.g., refresh or writing) period, the scan control signal 66 may instruct the scan control transistors 76 to each switch to and maintain its connected (e.g., conductive and/or closed) state, which also results in the current control transistor 78 switching to and/or maintaining its connected state. In this manner, the display pixel 54 may provide a direct electrical path 88 between the data line 58 and its internal node 74, thereby enabling the data line voltage signal 68 generated based on corresponding image data to adjust voltage at internal node 74, for example, by charging and/or discharging the storage capacitor 62. On the other hand, during an emission (e.g., display) period, the scan control signal 66 may instruct the scan control transistors 76 to each switch to and maintain its disconnected state, thereby blocking the direct electrical path 88 in attempt to maintain voltage at the internal node 74 and, thus, resulting light emission from the light-emitting diode 70 relatively constant.

However, at least in some instances, the voltage at the internal node 74 may nevertheless vary over an emission period during which an image is displayed, for example, due at least in part to leakage current flowing between the internal node 74 of the display pixel 54 and the data line 58. As an illustrative example, a leakage path 90 may enable electrical current to flow from the storage capacitor 62 through the pixel power supply rail 42A, the disconnected state first emission control transistor 80A, and the disconnected state first scan control transistor 76A to the data line 58, thereby gradually discharging the storage capacitor 62 and, thus, gradually reducing the voltage at the internal node 74 of the display pixel 54. Moreover, at least in some instances, parasitic capacitance 92 may occur between the data line 58 and electrically conductive material in the display pixel 54, for example, due to the data line 58 being disposed in close proximity to the display pixel 54. In other words, the parasitic capacitance 92 is not a physical capacitor and is depicted merely for illustrative purposes.

At least in some instance, the change in voltage over time (dv/dt) of electrical power flowing through the data line 58 during an emission period may induce an electrical current in the display pixel 54, which charges and/or discharges the storage capacitor 62 and, thus, changes the voltage at the internal node 74 of the display pixel 54. Generally, the change in voltage of the data line 58 resulting from the leakage current of a single display pixel 54 may be relatively small. However, when multiple display pixels 54 are coupled to the same data line 58, leakage current from the display pixels 54 may be combined in the data line 58, thereby producing larger voltage changes in the data line 58. In other words, in some embodiments, the magnitude of combined leakage current flowing through data lines 58 and, thus, voltage change induced by the combined leakage current may vary based at least in part on the number of display pixels 54 coupled thereto.

Moreover, as will be described in more detail below, in some embodiments, the voltage change resulting from the combined leakage current flowing through the data line 58 and the voltage change resulting from its own (e.g., individual) leakage current may produce a multi-order (e.g., second order) response in the voltage at the internal node 74 and, thus, resulting light emission during display (e.g., emission period) of an image. At least in some instances, such variations in light emission during display of an image (e.g., relative to itself, a preceding image, and/or a subsequent image) may result in a visual artifact, such as flicker, which when perceivable may affect (e.g., reduce) perceived quality of the image and, thus, potentially a display panel 40 and/or an electronic device 10 that is displaying the image. To facilitate reducing likelihood and/or perceivability of visual artifacts, in some embodiments, a display panel 40 may be implemented and/or operated to reduce magnitude of leakage current from its display pixels 54, for example, by supplying one or more intermediate voltages to its data lines 58 during display of an image.

Figure 9:
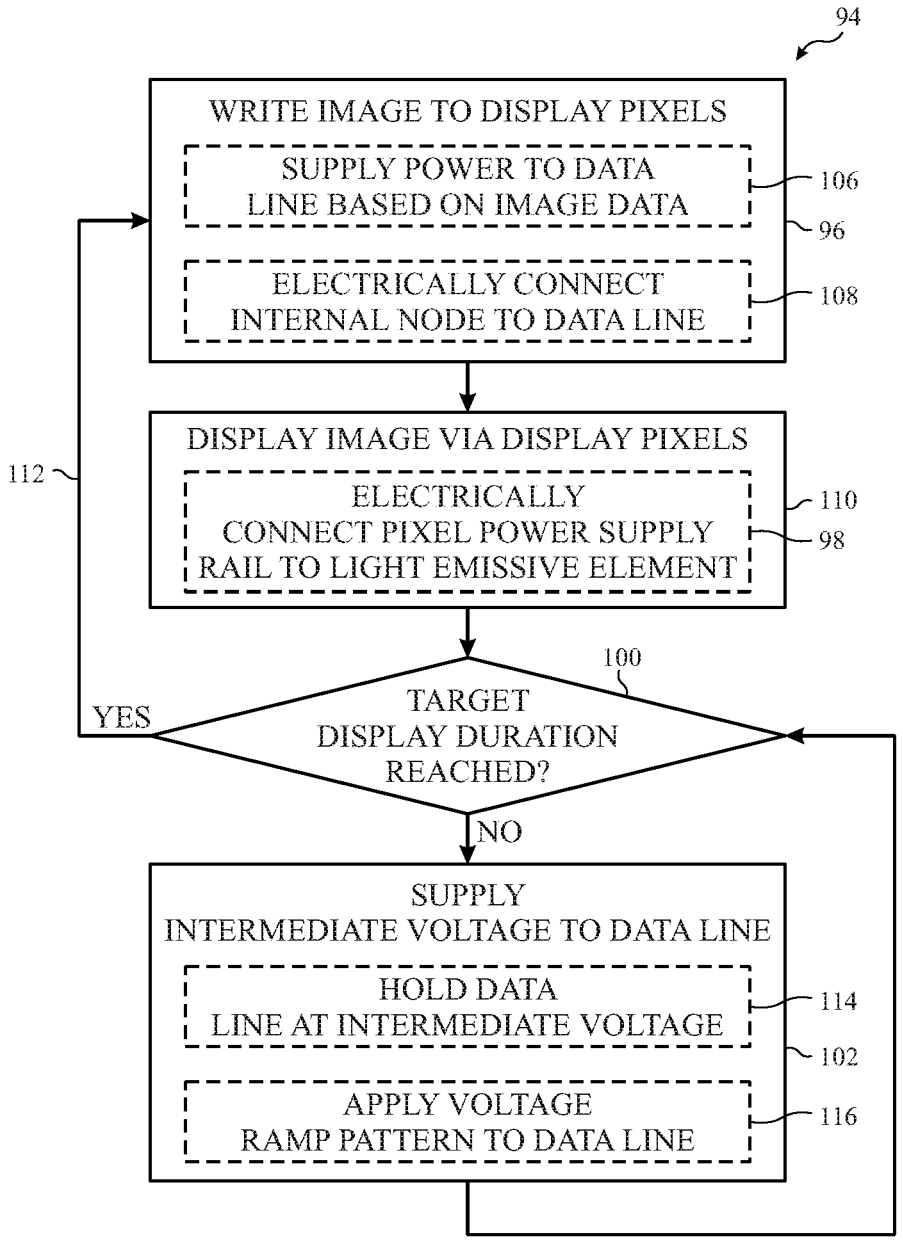
FIG. 9 is a flow diagram of an example process for operating the display panel of FIG. 7, in accordance with an embodiment of the present disclosure.

To help illustrate, an example of a process 94 for operating a display panel 40 is described in FIG. 9. Generally, the process 94 includes writing an image to display pixels (process block 96) and displaying the image via the display pixels (process block 98). Additionally, the process 94 includes determining whether a target display duration of the image has been reached (decision block 100) and supplying an intermediate voltage to a data line when the target display duration has not yet been reached (process block 102).

Although described in a particular order, which represents a particular embodiment, it should be noted that the process 94 may be performed in any suitable order. Additionally, embodiments of the process 94 may omit process blocks and/or include additional process blocks. Moreover, in some embodiments, the process 94 may be implemented at least in part by executing instructions stored in a tangible, non-transitory, computer-readable medium, such as controller memory 48, using processing circuitry, such as the controller processor 46.

Accordingly, in some embodiments, a controller 44 may instruct a display panel 40 to write an image to be displayed to its display pixels 54 (process block 96). As described above, in some embodiments, an image to be displayed during a subsequent emission (e.g., display) period may be written during a preceding non-emission (e.g., refresh or writing) period based at least in part on image data that indicates target luminance (e.g., grayscale levels) of the display pixels 54 in the image. Additionally, as described above, in some embodiments, light emission and, thus, perceived luminance of a display pixel 54 may vary with the amount of electrical energy stored in its storage capacitor 62.

Thus, in some embodiments, writing a display pixel 54 may include supplying electrical power to a data line 58 coupled to the display pixel 54 based at least in part on corresponding image data (process block 106) and electrically connecting an internal node 74 of the display pixel 54 to the data line 58 (process block 108). As described above, in some embodiments, a scan driver 50 may connect a direct electrical path 88 between the internal node 74 of display pixel and the data line 58 by instructing one or more scan control transistors 76 in the display pixel 54 to switch to and maintain its connected state, for example, via a logic low scan control signal 66. Additionally, as described above, in some embodiments, a data driver 52 may control (e.g., vary or adjust) magnitude of a data line voltage signal 68 supplied to the data line 58 such that voltage resulting at the internal node 74 of the display pixel 54 is expected to produce a luminance level that matches a target luminance level indicated by the image data.

After writing the display pixels 54, the controller 44 may instruct the display panel 40 to emit light from the display pixels 54, thereby displaying the image (process block 98). As described above, before displaying a corresponding portion of an image via a display pixel 54, in some embodiments, the scan driver 50 may disconnect the direct electrical path 88 between the internal node 74 of the display pixel and the data line 58 by instructing one or more scan control transistors 76 in the display pixel 54 to switch to and maintain its disconnected state, for example, via a logic high scan control signal 66. Additionally, as described above, in some embodiments, a display pixel 54 may include a light emissive element 64, such as a light-emitting diode 70, that varies its light emission based on the magnitude of electrical current flowing therethrough.

Accordingly, in some embodiments, displaying a corresponding non-black portion of an image via a display pixel 54 may include electrically connecting a pixel power supply rail 42A (e.g., $V_{DD}$) to a light emissive element 64 of the display pixel 54 (process 110). When one or more emission control transistors 80 are implemented in the display pixel, connecting the pixel power supply rail 42A (e.g., $V_{DD}$) to the light emissive element 64 may include instructing the one or more emission control transistors 80 to switch to and maintain its connected state, for example, via a logic high emission control signal 82. In this manner, the magnitude of electrical current supplied to the light emissive element 64 and, thus, light emission from the display pixel 54 may be controlled by the channel width of the current control transistor 78 and, thus, the voltage at the internal node 74 that is supplied to the control (e.g., gate) terminal of the current control transistor 78.

The controller 44 may instruct the display panel 40 to continue displaying the image until a target display duration of the image is reached (decision block 100). In some embodiments, the target display duration of an image may be pre-determined by the image source 38 and indicated in the image data, for example, via the number of vertical blank lines included in the image data. In other embodiments, the target display duration of an image may be adaptively (e.g., dynamically) determined, for example, based at least in part on a maximum display duration before a repeat of the image is to be displayed, when a next image is received, and/or a target presentation time associated with the next image. In any case, once the target display duration of the image has been reached, the controller 44 may again instruct the display panel 40 to write the next image to its display pixels 54, display the next image via its display pixels 54, and so on (arrow 112).

On the other hand, when the target display duration has not yet been reached, the controller 44 may instruct the display panel 40 to supply one or more intermediate voltages, each greater than a ground (e.g., zero) voltage, to its data lines 58 (process block 102). In some embodiments, an intermediate voltage supplied to a data line 58 during an emission period may be a mid-range voltage, for example, halfway between a low-end voltage corresponding with a black grayscale level and a high-end voltage corresponding with a white grayscale level. As an illustrative example, when a display pixel 54 is implemented such that 0.5 millivolts at its internal node 74 produces a black (e.g., lowest or dimmest) grayscale level and 10.5 millivolts at its internal node 74 produces a white (e.g., highest or brightest) grayscale level, the data driver 52 may supply the data line 58 an intermediate voltage of 5.5 millivolts during the emission period in which the image is being displayed. Moreover, in some embodiments, the data driver 52 may be implemented and/or operated to supply an intermediate voltage to a data line 58 such that the data line 58 is held at the intermediate voltage during the emission period, for example, instead of attempting to hold the data line 58 at the ground (e.g., zero) voltage (process block 114).

Figure 10:
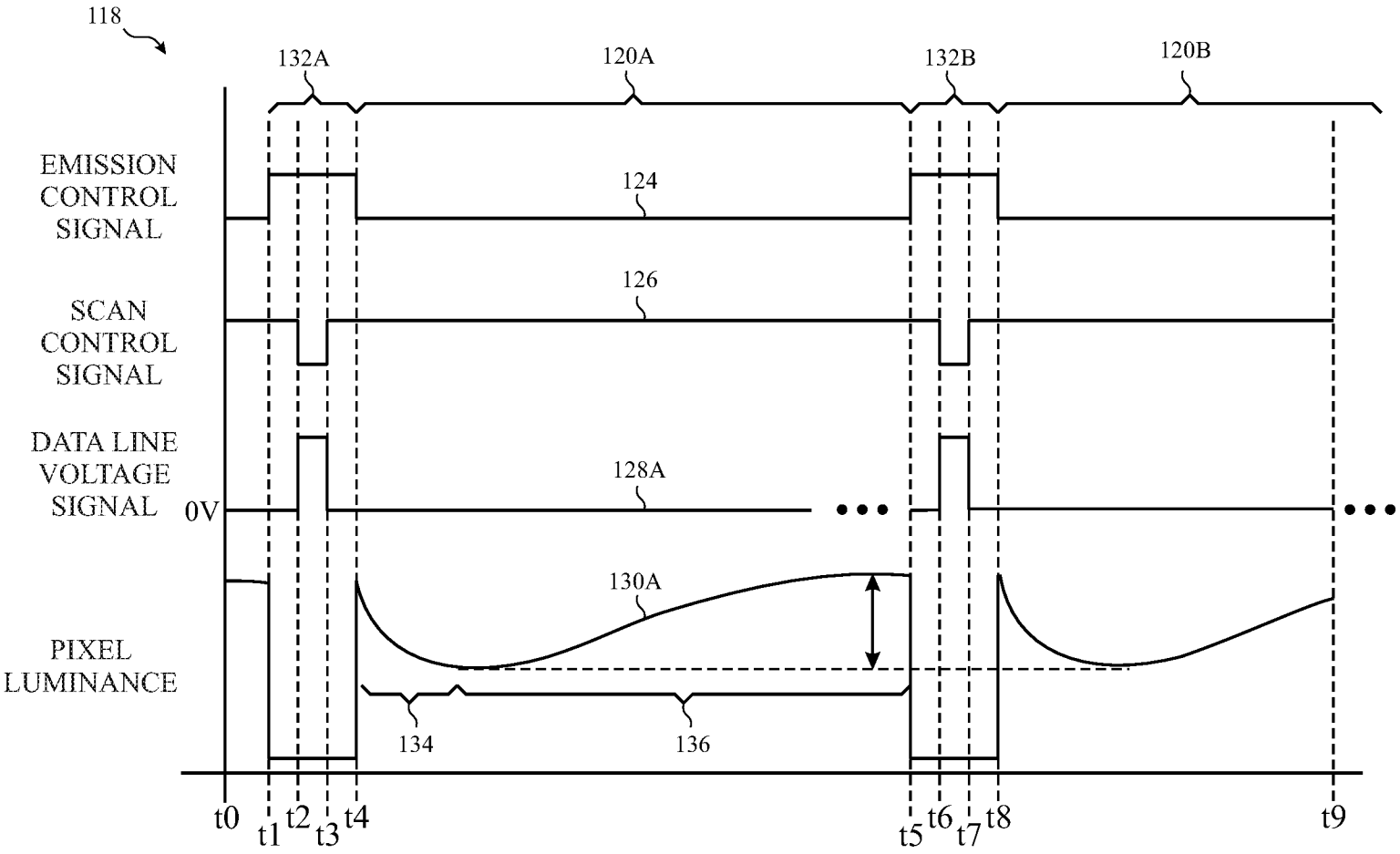
FIG. 10 is an example timing diagram that describes an emission control signal, a scan control signal, a data line voltage signal that is a ground voltage during emission periods, and a resulting pixel luminance, in accordance with an embodiment of the present disclosure.
Figure 11:
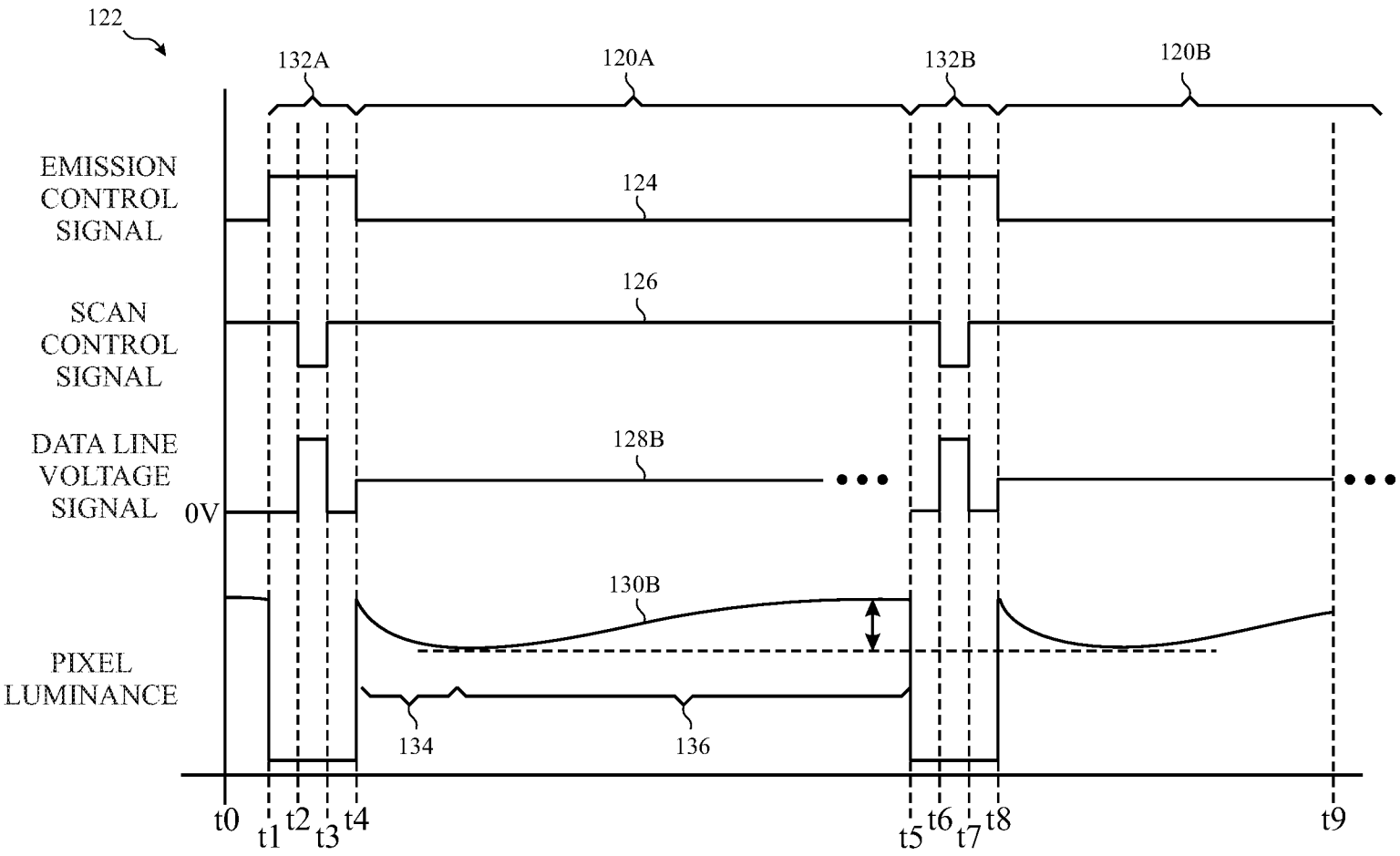
FIG. 11 is an example timing diagram that describes an emission control signal, a scan control signal, a data line voltage signal that is held at an intermediate voltage during emission periods, and a resulting pixel luminance, in accordance with an embodiment of the present disclosure.

To help further illustrate, an example of a first timing diagram 118, which describes pixel luminance resulting from holding a data line 58 at a ground voltage (e.g., zero volts) during emission periods 120, is shown in FIG. 10 and an example of a second timing diagram 122, which describes pixel luminance resulting from holding the data line 58 at an intermediate voltage during emission periods 120, is shown in FIG. 11. As depicted, the first timing diagram 118 and the second timing diagram 122 each includes an emission control signal waveform 124, which describes timing of an emission control signal 82 supplied to a display pixel 54 from time t0 to time t9, and a scan control signal waveform 126, which describes timing of a scan control signal 66 supplied to the display pixel 54 from time t0 to time t9. Additionally, the first timing diagram 118 and the second timing diagram 122 each includes a data line voltage waveform 128, which describes timing and magnitude of a data line voltage signal 68 supplied to a data line 58 coupled to the display pixel 54 from time t0 to time t9, and a pixel luminance waveform 130, which describes resulting light emission from the display pixel 54 from time t0 to time t9.

More specifically, the first timing diagram 118 includes a first data line voltage waveform 128A, which describes a first data line voltage signal 68 that is applied to hold the data line 58 at the ground voltage during emission periods 120, and a first pixel luminance waveform 130A, which describes resulting light emission from the display pixel 54. On the other hand, the second timing diagram 122 includes a second data line voltage waveform 128B, which describes a second data line voltage signal 68 that is applied to hold the data line 58 at the intermediate voltage during emission periods 120, and a second pixel luminance waveform 130B, which describes resulting light emission from the display pixel 54. As depicted, a first emission period 120A occurs following a first non-emission period 132A, during which a first image to be displayed during the first emission period 120A is written to the display pixel 54, and a second emission period 120B occurs following a second non-emission period 132B, during which a second image to be displayed during the second emission period 120B is written to the display pixel 54.

In particular, as depicted, the first non-emission period 132A occurs from time t1 to time t4 and the second non-emission period 132B occurs from time t5 to time t8. Thus, as in the depicted examples, the emission control signal 82 may switch from its emission enable (e.g., logic low) state to its emission disable (e.g., logic high) state at time t1 and maintain its emission disable state before switching back to its emission enable state at time t4. Similarly, as in the depicted examples, the emission control signal 82 may switch from its emission enable state to its emission disable at time t5 and maintain its emission disable state before switching back to its emission enable state at time t8.

As described above, in some embodiments, a display pixel 54 may be written during a non-emission period 132 by storing electrical energy in its storage capacitor 62 via a data line voltage signal 68 generated based at least in part on image data that indicates target grayscale (e.g., luminance) level of the display pixel 54 in an image to be displayed during a following emission period 120. Thus, as in the depicted examples, the scan control signal 66 may switch from its write disable (e.g., logic high) state to its write enable (e.g., logic low) state at time t2 and maintain its write enable state until time t3 to enable writing the display pixel using the data line voltage signal 68 being supplied to the data line 58 between time t2 and time t3. Similarly, as in the depicted examples, the scan control signal 66 may switch from its write disable state to its write enable state at time t6 and maintain its write enable state until time t7 to enable writing the display pixel using the data line voltage signal 68 being supplied to the data line 58 between time t6 and time t7.

Although the scan control signal 66 and the data line voltage signals 68 are depicted as toggling simultaneously (e.g., concurrently), it should be appreciated that the depicted examples are merely intended to be illustrative and not limiting. In particular, during a non-emission period 132, in some embodiments, the data line voltage signal 68 may transition to a voltage magnitude generated based on image data corresponding with the display pixel 54 before the scan control signal 66 toggles from its write disable state to its write enable and/or maintain the voltage magnitude generated based on the image data even after the scan control signal 66 toggles back to its write disable state. In other words, in other embodiments, the data line voltage signal 68 may transition to the voltage magnitude generated based on the image data before time t2 and/or maintain the voltage magnitude generated based on the image data until another time between time t3 and time t4.

Furthermore, as depicted, the first emission period 120A occurs from time t4 to time t5 and the second emission period occurs from time t8 through time t9. Thus, as in the depicted examples, the emission control signal 82 may switch from its emission disable (e.g., logic high) state to its emission enable (e.g., logic low) state at time t4 and maintain its emission enable state before switching back to its emission disable state at time t5. Similarly, as in the depicted examples, the emission control signal 82 may switch from its emission disable (e.g., logic high) state to its emission enable (e.g., logic low) state at time t8 and maintain its emission enable state at least until time t9.

As described above, during an emission period, leakage current that affects voltage at the internal node 74 of a display pixel 54 may flow between the internal node 74 and a data line 58 coupled to the display pixel 54. Moreover, at least in some instances, the leakage current from multiple display pixels 54 coupled to a data line 58 may result in voltage of the data line 58 changing over time (e.g., dv/dt) in such a manner that produces a multi-order (e.g., second-order) response in the voltage at the internal nodes 74 and, thus, light emission from the display pixels 54. For example, during a first (e.g., initial) portion 134 of an emission period 120, changes in voltage at the internal node of the display pixel 54 may primarily result from leakage current flowing from its storage capacitor 62 through one or more closed state switching devices 60. Thus, as in the depicted examples, during the first portion 134 of the emission period 120, the voltage at the internal node 74 and, thus, resulting pixel luminance (e.g., light emission from the display pixel 54) may gradually decrease due its own (e.g., individual) leakage current.

However, as its own leakage current combines with leakage current from one or more other display pixels 54 coupled to the data line 58, at least in some instances, the combined leakage current flowing through the data line 58 may induce an electrical current in the display pixel 54 that affects (e.g., changes) the voltage at its internal node 74, for example, by charging and/or discharging the storage capacitor 62 coupled to the internal node 74. Since electrically conductive material generally has some amount of inductance that resists changes in electrical current, magnitude of a combined leakage current flowing through a data line 58 generally increases over time. In other words, the influence of the combined leakage current on the voltage at the internal node 74 and, thus, resulting pixel luminance generally increases the longer an image is displayed.

Thus, as in the depicted examples, during a second (e.g., later or subsequent) portion 136 of an emission period 120, the increased influence of the combined leakage current may result in the voltage at the internal node 74 and, thus, pixel luminance varying non-monotonically during the emission period 120. In particular, as in the depicted example, the pixel luminance may gradually decrease during the first portion 134 of the emission period 120 before gradually increasing during the second portion 136 of the emission period 120, for example, due to the electrical current induced by the combined leakage current flowing through the data line 58 charging the storage capacitor 62 of the display pixel 54. In fact, in some embodiments, the combined leakage current may result in the pixel luminance varying non-monotonically during the second portion 136 of the emission period 120, for example, such that, after gradually increasing, the pixel luminance again begins to gradually decrease.

As depicted in FIG. 11, since some amount of leakage current may still occurs when the data line 58 is held at the intermediate voltage during the emission periods 120, the resulting pixel luminance may nevertheless exhibit a multi-order response. However, since the intermediate voltage is a mid-range voltage, at least in some embodiments, the voltage difference at the internal node 74 of the display pixel 54 relative to the intermediate voltage may generally (e.g., at least on average) be less than the voltage difference relative to the ground voltage. Additionally, since magnitude of electrical current is generally proportional to a voltage difference between which it flow, at least in some embodiments, holding the data line 58 at the intermediate voltage during an emission period 120 may facilitate reducing the magnitude of leakage current flowing between the internal node 74 of the display pixel 54 and the data line 58 and, thus, magnitude of resulting voltage change at the internal node of the display pixel 54.

Accordingly, as in the depicted examples, holding the data line 58 at the intermediate voltage may facilitate stabilizing (e.g., reducing variation in) the voltage at the internal node 74 and, thus, resulting light emission from the display pixel 54 during display (e.g., emission period 120) of an image. In other words, at least in some embodiments, operating a data driver 52 to hold a data line 58 at an intermediate voltage during display (e.g., emission period 120) of an image may facilitate reducing likelihood of the image being displayed with a perceivable of visual artifact, such as a perceivable flicker relative to itself, a preceding image, and/or a subsequent image, and, thus, facilitate improving perceived image quality (process block 114). To facilitate further improving perceived image quality, in some embodiments, a data driver 52 may additionally or alternatively be implemented and/or operated to leverage parasitic capacitance 92 between electrical conductive material in a display pixel 54 and a data line 58 coupled to the display pixel 54 by applying a voltage ramp pattern that ramps the voltage of the data line 58 to one or more intermediate voltages during display of an image (process block 116).

Figure 12:
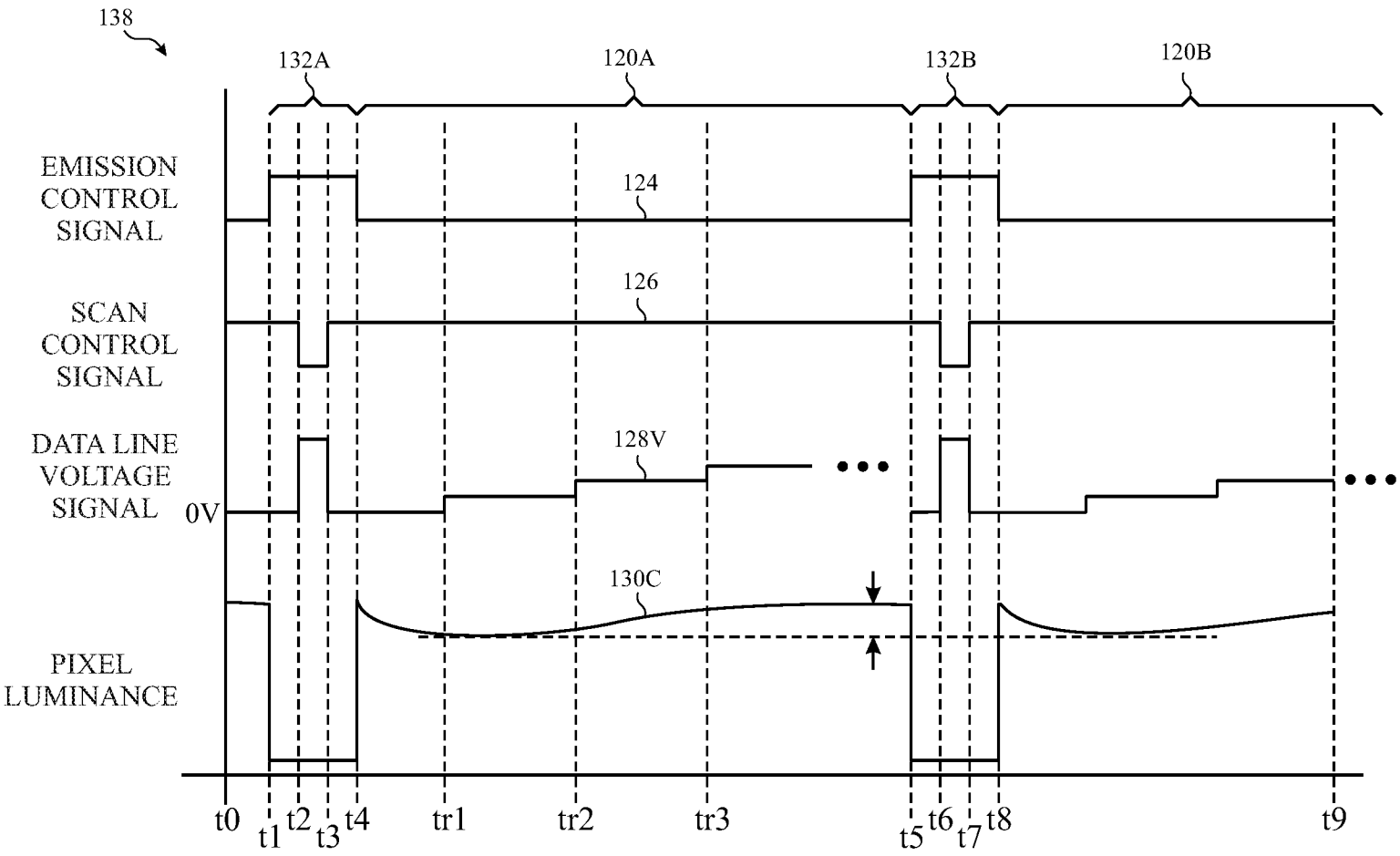
FIG. 12 is an example timing diagram that describes an emission control signal, a scan control signal, a data line voltage signal that is ramped to multiple intermediate voltages during emission periods, and a resulting pixel luminance, in accordance with an embodiment of the present disclosure.

To help illustrate, an example of a third timing diagram 138, which describes pixel luminance resulting from ramping voltage of a data line 58 to multiple intermediate voltages, is shown in FIG. 12. As depicted, the third timing diagram 138 includes an emission control signal waveform 124, which matches the emission control signal waveforms 124 depicted in FIGS. 10 and 11, and a scan control signal waveform 126, which matches the scan control signal waveforms 126 depicted in FIGS. 10 and 11. Additionally, as depicted in the FIG. 12, the third timing diagram 138 includes a third data line voltage waveform 128C, which describes a third data line voltage signal 68 that is applied to ramp a data line 58 to multiple intermediate voltages during emission periods, and a third pixel luminance waveform 132C, which describes resulting light emission from a display pixel 54 coupled to the data line 58.

More specifically, as depicted, during an emission period 120, the third data line voltage signal 68 is ramped from a ground voltage to a first (e.g., lowest) intermediate voltage at a first ramp time tr1, from the first intermediate voltage to a second (e.g., higher) intermediate voltage at a second ramp time tr2, and from the second intermediate voltage to a third (e.g., highest) intermediate voltage at a third ramp time tr3. It should be appreciated that changes in voltage of the data line 58 are generally non-instantaneous and, thus, occur over a non-negligible ramping duration. As described above, due to parasitic capacitance 92, changes in voltage over time (e.g., dv/dt) of electrical current flowing through a data line 58 may induce an electrical current in a display pixel 54 that affects (e.g., changes) the voltage at its internal node 74. Accordingly, as in the depicted example, ramping the voltage of the data line 58 to an intermediate voltage during the emission period 120 may facilitate counteracting voltage variations at the internal node 74 of the display pixel 54 and, thus, facilitate further stabilizing pixel luminance during the emission period 120, for example, compared to simply holding the data line 58 at the intermediate voltage.

In some embodiments, ramping the voltage of the data line 58 to an intermediate voltage may facilitate reducing voltage variations at the internal node 74 at least in part by replenishing electrical energy lost to leakage current during the emission period 120. For example, a data driver 52 may ramp the voltage of the data line 58 to the first intermediate voltage to facilitate replenishing the electrical energy lost to leakage current between time t4 and the first ramp time tr1. Additionally or alternatively, ramping the voltage of the data line 58 to an intermediate voltage may facilitate reducing voltage variations at the internal node 74 at least in part by offsetting electrical energy injected into the display pixel by a combined leakage current flowing through the data line 58. For example, a data driver 52 may ramp the voltage of the data line to the third intermediate voltage to induce an electrical current in the display pixel 54 that discharges electrical energy injected into the display pixel 54 between time t4 and the third ramp time tr3.

Furthermore, as depicted, during the emission period 120, the third data line voltage signal 68 is applied to hold voltage of the data line 58 at the first intermediate voltage until the second ramp time tr2 is reached, to hold voltage of the data line 58 at the second intermediate voltage until the third ramp time tr3 is reached, and so on. As described above, in some embodiments, holding a data line 58 at an intermediate voltage during an emission period 120 may facilitate reducing the magnitude of leakage current and, thus, stabilizing light emission from a display pixel 54 coupled to the data line 58 compared to holding the data line at a ground voltage, for example, due at least in part to the difference between voltage at the internal node 74 of the display pixel 54 and the intermediate voltage being smaller than the difference between voltage at the internal node 74 and the ground voltage.

However, it should be appreciated that the depicted example is merely intended to be illustrative and not limiting. For example, instead of holding the voltage of a data line 58 at an intermediate voltage during an emission period 120, in other embodiments, a data driver 52 may be implemented and/or operated to apply a voltage ramp pattern that continuously ramps the voltage of the data line 58 during the emission period 120. Additionally or alternatively, in other embodiments, a data driver 52 may be implemented and/or operated to apply a voltage ramp pattern that includes fewer than three intermediate voltage steps or more than three intermediate voltage steps. In fact, in some embodiments, a target voltage pattern (e.g., target voltage ramp pattern and/or a target hold voltage) to be applied to a data line 58 may be adaptively (e.g., dynamically) determined, for example, to enable different target intermediate voltages to be applied to different data lines 58 and/or during different emission periods 120.

Figure 13:
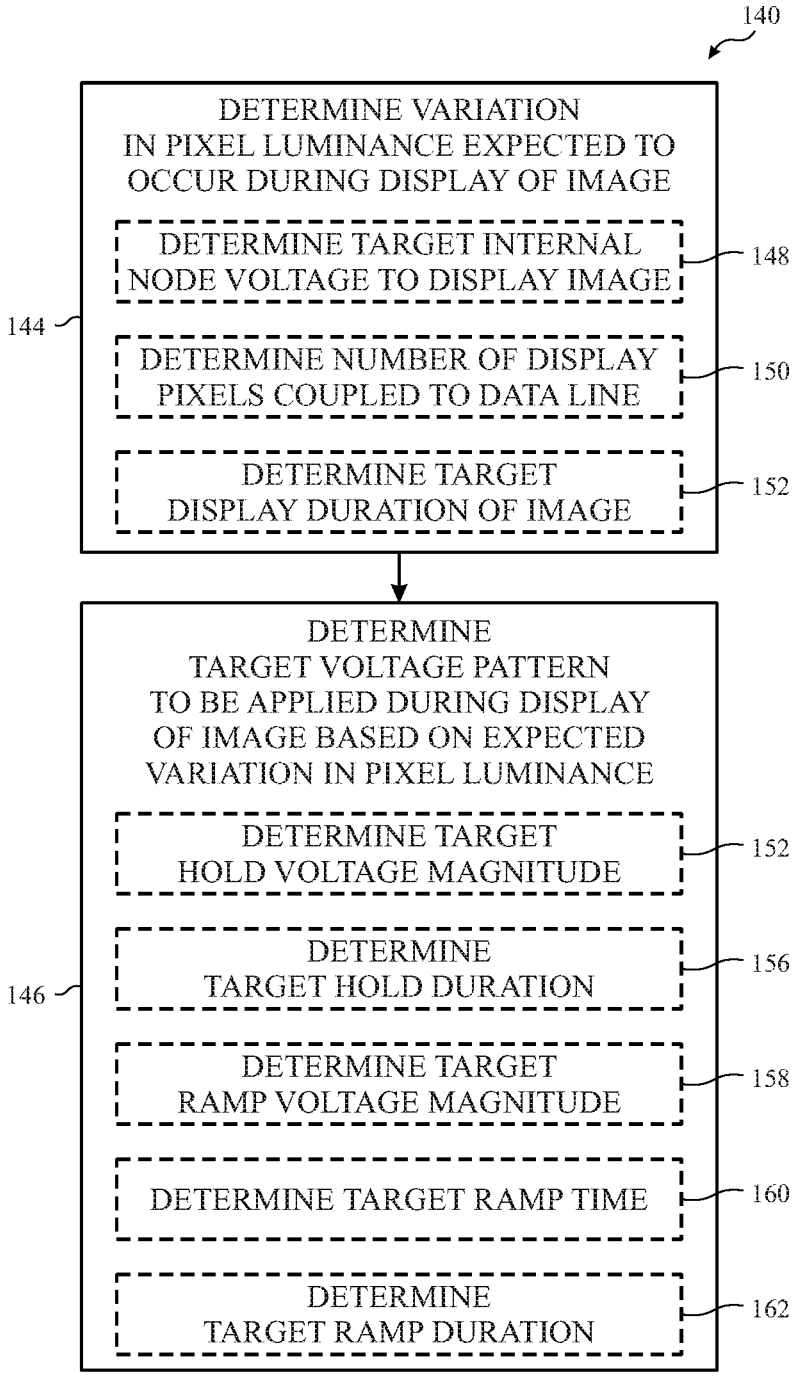
FIG. 13 is a flow diagram of an example process for determining a target voltage pattern to be applied to a data line during an emission period, in accordance with an embodiment of the present disclosure.

To help illustrate, an example of a process 140 for determining a target voltage pattern (e.g., target voltage ramp pattern and/or target hold voltage) to be applied to a data line 58 is described in FIG. 13. Generally, the process 140 includes determining variation in pixel luminance expected to occur during display of an image (process block 144) and determining parameters of a target voltage pattern to be applied during display of the image based on the expected variation in pixel luminance (process block 146). Although described in a particular order, which represents a particular embodiment, it should be noted that the process 140 may be performed in any suitable order. Additionally, embodiments of the process 140 may omit process blocks and/or include additional process blocks.

Furthermore, in some embodiments, the process 140 may be performed offline, for example, by a manufacturer of a display panel 40 and/or a system integrator that produces an electronic device 10 that include the display panel 40 to pre-determine the target voltage pattern. Additionally or alternatively, the process 140 may be performed online during operation of the display panel 40 and/or the electronic device 10. Moreover, in some embodiments, the process 140 may be implemented at least in part by executing instructions stored in a tangible, non-transitory, computer-readable medium, such as controller memory 48, using processing circuitry, such as the controller processor 46.

Accordingly, in some embodiments, a controller 44 may determine (e.g., predict) variation in pixel luminance expected to occur during display of an image via display pixels 54 implemented on a display panel 40 (process block 144). In other words, the controller 44 may predict the likelihood that the image will be displayed with perceivable visual artifacts, such as a perceivable flicker relative to itself, a preceding image, and/or a following image. As described above, at least in some instances, variations in light emission (e.g., luminance) of a display pixel 54 may result from a voltage change at its internal node 74 produced by its own (e.g., individual) leakage current and/or a voltage change at its internal node 74 produced by a combined leakage current flowing through a data line 58 coupled to the display pixel 54. Additionally, as described above, leakage current may flow from an internal node 74 of a display pixel 54 through one or more disconnected state switching devices 60 to a data line 58 coupled to the display pixel 54 due at least in part to a voltage difference between the internal node 74 and the data line 58. In other words, since magnitude of electrical current is generally proportional to a voltage difference between which it flows, at least in some instances, the magnitude of leakage current flowing between the internal node 74 of the display pixel 54 and the data line 58 and, thus, the resulting voltage change at the internal node 74 may depend at least in part on an initial voltage of at internal node 74.

Accordingly, to facilitate determining the expected pixel luminance variation, in some embodiments, the controller 44 may determine the target voltage at the internal node 74 of a display pixel 54 to be used to display the image (process block 148). As described above, the voltage at the internal node 74 of a display pixel 54 may be used to control light emission from the display pixel 54 such that is actual (e.g., perceived) pixel luminance matches or at least is within a threshold range of a target luminance (e.g., grayscale value) indicated by corresponding image data. As such, in some embodiments, the controller 44 may determine the target voltage at the internal node 74 based on image data to be used to write a corresponding portion of the image to the display pixel 54. In other words, at least in such embodiments, the controller 44 may determine the pixel luminance variation expected to occur during display of the image based at least in part on the image content.

Additionally, based at least in part on the target voltage at the internal node 74, the controller 44 may determine (e.g., predict) the magnitude of an individual leakage current expected to flow between the internal node 74 and the data line 58 and, thus, the affect the individual leakage current is expected to have on pixel luminance during display of the image. For example, when magnitude of the target voltage is higher, the controller 44 may predict that a higher magnitude individual leakage current is expected to flow between the internal node 74 and the data line 58 and, thus, result in more variations in pixel luminance during display of the image. Conversely, when magnitude of the target voltage is lower, the controller 44 may predict that a lower magnitude individual leakage current is expected to flow between the internal node 74 and the data line 58 and, thus, result in less variations in pixel luminance during display of the image.

Furthermore, as described above, the magnitude of a combined leakage current flowing through a data line 58 and, thus, influence of the combined leakage current on voltage at the internal node 74 of a display pixel 54 may vary with the number of display pixels 54 coupled thereto. For example, when more display pixels 54 are coupled to a data line 58, a larger number of display pixels 54 may contribute leakage current and, thus, generally result in a higher magnitude combined leakage current flowing through the data line 58. Conversely, when fewer display pixels 54 are coupled to a data line 58, a smaller number of display pixels 54 may contribute leakage current and, thus, generally result in a lower magnitude combined leakage current flowing through the data line 58.

Thus, to facilitate determining the expected variation in pixel luminance, in some embodiments, the controller 44 may determine the number of display pixels 54 coupled to a data line 58 (process block 152). In some embodiments, an indication of the number of display pixels 54 coupled to each data line 58 on a display panel 40 may be pre-determined and stored in a tangible, non-transitory, computer-readable medium, such as controller memory 48. Thus, at least in such embodiments, the controller 44 may determine the number of display pixels 54 coupled to a data line 58 at least in part by retrieving a corresponding indication from the tangible, non-transitory, computer-readable medium.

Based at least in part on the number of display pixels 54 coupled thereto, the controller 44 may determine (e.g., predict) the magnitude of a combined leakage current expected to flow through the data line 58 and, thus, the affect the combined leakage current is expected to have on pixel luminance during display of the image. For example, when a larger number of display pixels 54 are coupled to the data line 58, the controller 44 may predict that a higher magnitude combined leakage current is expected to flow through the data line 58 and, thus, result in more variations in pixel luminance during display of the image. Conversely, when a smaller number of display pixels 54 are coupled to the data line 58, the controller 44 may predict that a lower magnitude combined leakage current is expected to flow through the data line 58 and, thus, result in less variations in pixel luminance during display of the image.

Moreover, as described above, at least in some instances, influences on light emission (e.g., pixel luminance) from a display pixel 54 may vary over the course of an emission period 120 during which an image is displayed. For example, as described above, combined leakage current flowing through a data line 58 coupled to the display pixel 54 may exhibit a weaker influence on light emission from the display pixel during a first (e.g., initial) portion 134 of the emission period 120, thereby resulting in individual leakage current of the display pixel 54 being the primary influence on changes in its light emission during the first portion 134 of the emission period 120. However, as described above, the combined leakage current flowing through the data line 58 may exhibit a stronger influence on light emission from the display pixel 54 during a second (e.g., subsequent) portion 136 of the emission period 120.

In other words, in some embodiments, the influence of a combined leakage current flowing through a data line 58 on light emission from a display pixel 54 coupled to the data line 58 may be minimal when the display duration of the image has not yet reach a duration threshold. For example, in some embodiments, the duration threshold may be set as the duration of the first portion 134 of an emission period 120. In fact, in some embodiments, the controller 44 may decide not to apply an intermediate voltage during an emission period 120 in which the image is displayed when the target display duration of the image is less than the duration threshold, for example, to facilitate reducing power consumption of the display panel 40.

Additionally or alternatively, the controller 44 determine (e.g., predict) a pixel luminance trajectory that indicates pixel luminance expect to occur at different times during the course of the target display duration, for example, when the target display duration is not less than the duration threshold. To predict the pixel luminance trajectory, in some embodiments, the controller 44 may adaptively vary influence (e.g., consideration and/or weighting) of individual leakage current and/or combined leakage current on its prediction of the pixel luminance expected to occur at different times during the target display duration. In other words, the predicted luminance trajectory may indicate variations in pixel luminance expected to occur between different times during display of the image.

To facilitate improving perceived image quality, based at least in part on the expected variation in pixel luminance, the controller 44 may determine one or more parameters of a target voltage pattern (e.g., target hold voltage and/or target voltage ramp pattern) to be applied to a data line 58 during an emission period 120 in which the image is to be displayed (process block 146). As described above, in some embodiments, a data line 58 may be held at an intermediate voltage during an emission period 120. Thus, in some embodiments, determining one or more parameters of a target voltage pattern may include determining a target hold voltage magnitude (process block 152) and/or a target hold duration (process block 156). For example, when the data line 58 is to be held at a single intermediate voltage, the controller 44 may set the target hold duration as the expected duration of the emission period 120 (e.g., target display duration).

Additionally or alternatively, the controller 44 may set the target hold voltage to be applied to the data line 58 to facilitate minimizing voltage difference between the data line 58 and the internal nodes 74 of display pixels 54 coupled to the data line 58. In some embodiments, the controller 44 may set the target hold voltage independent of image content, for example, such that the target hold voltage is a mid-range voltage halfway between a low-end voltage corresponding with a black grayscale level and a high-end voltage corresponding with a white grayscale level. Additionally or alternatively, the controller 44 may set the target hold voltage based at least in part on the image content. For example, the controller 44 may set the target hold voltage as the average (e.g., mean) of a highest target internal node voltage associated with the display pixels 54 coupled to the data line 58 and a lowest target internal node voltage associated with the display pixels 54 coupled to the data line 58. Additionally or alternatively, the controller 44 may set the target hold voltage as the average and/or the median of the target internal node voltages associated with each of the display pixels 54 coupled to the data line 58.

Furthermore, as described above, in some embodiments, a voltage ramp pattern may ramp to one or more intermediate (e.g., ramp) voltages. Thus, in some embodiments, determining one or more parameters of a target voltage ramp pattern may include determining magnitude of one or more target ramp voltages (process block 158), determining one or more target ramp times, which each indicates when to initiate ramping to a corresponding target ramp voltage (process block 160), and/or determining one or more target ramp durations, which each indicates a duration (e.g., period) over which to ramp to a corresponding target ramp voltage (process block 162). In some embodiments, determining one or more parameters of a target voltage ramp pattern may additionally or alternatively include determining one or more target hold durations, which each indicates a duration over which to hold a corresponding target ramp voltage (process block 156).

For example, when more variation in pixel luminance is expected to occur, the controller 44 may set a target ramp voltage at a higher magnitude and/or a corresponding target ramp duration at a longer duration. In this manner, the parameters of the target voltage ramp pattern may be determined to produce a larger change in voltage over time (e.g., dv/dt), which, at least in some instances, may facilitate counteracting the increased variation in pixel luminance. Conversely, when less variation in pixel luminance is expected to occur, the controller 44 may set the target ramp voltage at a lower magnitude and/or the corresponding target ramp duration during at a shorter duration. In this manner, the parameters of the target voltage ramp pattern may be determined to produce a smaller change in voltage over time (e.g., dv/dt), which, at least in some instances, may be sufficient to counteract the expected variation in pixel luminance while reducing power consumption.

Additionally or alternatively, the controller 44 may set a target ramp time based at least in part on expected timing of variations in influences, such as individual leakage current and/or combined leakage current, on pixel luminance. For example, when the target display duration is not less than a duration threshold (e.g., duration of first portion 134 of emission period 120), the controller 44 may set the target ramp time such that the target voltage ramp pattern begins ramping to a target ramp voltage when the duration threshold is reached. In this manner, parameters of a target voltage pattern (e.g., target voltage ramp pattern and/or target hold voltage) to be applied to data lines 58 during display of an image may be determined to facilitate reducing magnitude and/or number of variations in pixel luminance, which, at least in some instances, may facilitate improving perceived image quality, for example, at least in part by reducing likelihood and/or perceivability of visual artifacts, such as a flicker, resulting from the pixel luminance variations.

As described above, a data driver 52 may be implemented and/or operated to apply a target intermediate (e.g., hold) voltage and/or a target voltage ramp pattern to data lines 58 on a display panel 40 during an emission (e.g., display) period 120. Additionally, during a non-emission (e.g., refresh or writing) period 132, as described above, a data driver 52 may be implemented and/or operated to write display pixels 54 on a display panel 40 by supplying data line voltage signals 68 generated based at least in part on corresponding image data to data lines 58 on the display panel 40. In fact, in some embodiments, a data driver 52 may be implemented and/or operated to control voltage of a data line 58 during emission periods 120 and non-emission periods 132 in an analogous manner.

Figure 14:
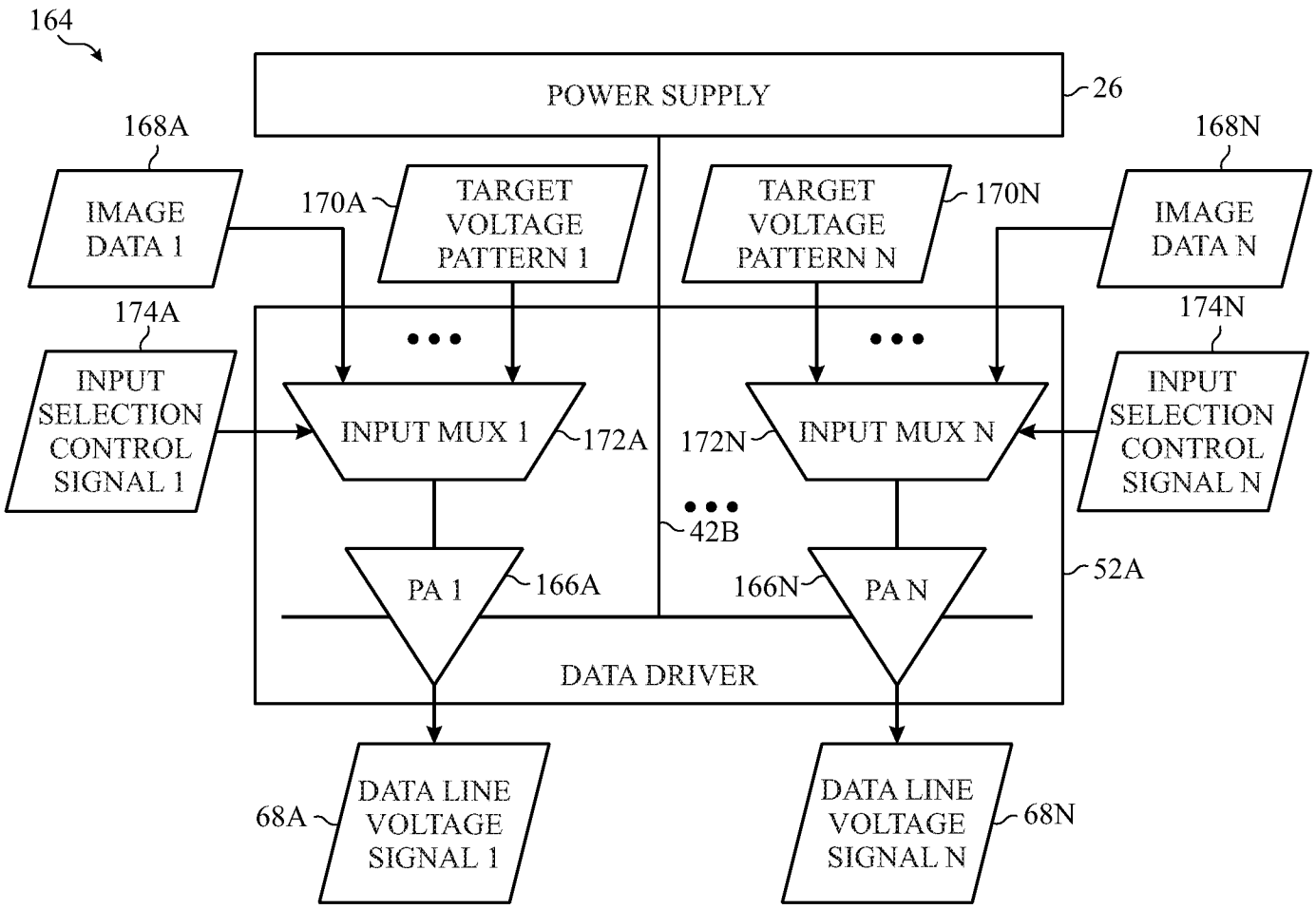
FIG. 14 is a block diagram of an example portion of the electronic device of FIG. 1 including a power supply and the data driver of FIG. 7 implemented with input multiplexers, in accordance with an embodiment of the present disclosure.

To help illustrate, an example of a portion 164 of an electronic device 10, which includes a data driver 52A and a power supply 25, is shown in FIG. 14. As in the depicted example, the data driver 52A may include multiple power amplifiers 166, which may each be coupled to a corresponding data line 58. For example, a first power amplifier 166A may be coupled to a first data line 58A and an Nth power amplifier 166N may be coupled to an Nth data line 58N. Thus, in some embodiments, the first power amplifier 166A may be implemented and/or operated to supply (e.g., output) a first data line voltage signal 68A to the first data line 58A while the Nth power amplifier 166N may be implemented and/or operated to supply an Nth data line voltage signal 68N to the Nth data line 58N.

However, it should be appreciated that the depicted example is merely intended to be illustrative and not limiting. In particular, in other embodiments, a data driver 52 may be coupled to more than two data lines 58 and, thus, include more than two power amplifiers 166. Alternatively or alternatively, in other embodiments, a power amplifier 166 implemented in a data driver 52 may be shared by multiple data lines 58, for example, such that the data driver selectively outputs a data line voltage signal 68 to subsets of the multiple data lines 58.

As described above, a data driver 52 may facilitate writing an image to display pixels 54 of a display panel 40 by generating data line voltage signals 68 based at least in part on corresponding image data 168, for example, which indicates target luminance (e.g., grayscale level) of the display pixels 54 in the image. In other words, during a non-emission period 132, the first power amplifier 166A may be implemented and/or operated to generate the first data line voltage signal 68A by amplifying first image data 168A corresponding with one or more display pixels 54 coupled to the first data line 58A. Similarly, during the non-emission period 132, the Nth power amplifier 166N may be implemented and/or operated to generate the Nth data line voltage signal 68N by amplifying Nth image data 168N corresponding with one or more display pixels 54 coupled to the Nth data line 58N.

Additionally, as described above, a data driver 52 may facilitate stabilizing pixel luminance by outputting data line voltage signals 68 that include one or more intermediate voltages greater than a ground (e.g., zero) voltage. For example, during an emission period 120, the first power amplifier 166A may be implemented and/or operated to generate the first data line voltage signal 68A by amplifying a first target voltage pattern (e.g., first target hold voltage and/or first target voltage ramp pattern) 170A to be applied to the first data line 58A. Similarly, during the emission period 120, the Nth power amplifier 166N may be implemented and/or operated to generate the Nth data line voltage signal 68N by amplifying an Nth target voltage pattern (e.g., Nth target hold voltage and/or Nth target voltage ramp pattern) 170N to be applied to the Nth data line 58N.

In other words, in some embodiments, an input to a power amplifier 166 may be selectively switched between image data 168 and a target voltage pattern 170, for example, based on whether in an emission period 120 or a non-emission period 132. To facilitate selectively switching its input, as in the depicted example, the input of the power amplifier 166 may be coupled to an input multiplexer 172 that receives the image data 168 and the target voltage pattern 170. For example, a first input multiplexer 172A may selectively switch between supplying the first image data 168A and the first target voltage pattern 170A to the first power amplifier 166A based on a first input selection control signal 174A. Similarly, a Nth input multiplexer 172N may selectively switch between supplying the Nth image data 168N and the Nth target voltage pattern 170N to the Nth power amplifier 166N based on an Nth input selection control signal 174N.

However, it should again be appreciated that the depicted example is merely intended to be illustrative and not limiting. For example, in other embodiments, multiple candidate voltage patterns may be supplied to an input multiplexer 172 and, thus when a target voltage pattern (e.g., target hold voltage and/or target voltage ramp pattern) 170 is to be supplied to a corresponding power amplifier 166, the input multiplexer 172 may select the target voltage pattern 170 from the multiple candidates. In fact, in some embodiments, different target voltage patterns 170 may be selected for different data lines 58, for example, due to the data lines 58 being coupled to differing number of display pixels 54 and/or image content corresponding with the display pixels 54 coupled to the data lines 58 differing. Additionally or alternatively, different target voltage patterns 170 may be selected for application to a data line 58 during display of different images, for example, due to display duration of the images differing and/or image content corresponding with display pixels 54 coupled to the data line 58 differing.

Generally, operating a power amplifier 166 to amplify an input signal consumes electrical power. Thus, as in the depicted example, the power amplifiers 166 implemented in the data driver 52A may be electrically coupled to the power supply 25 via an amplifier power supply rail 42B. Moreover, a power amplifier 166 is generally not ideal and, thus, operates at less than 100% efficiency. In other words, at least in some embodiments, continuing to operate the power amplifiers 166 during non-emission periods 132 may affect (e.g., reduce) operational efficiency of the data driver 52A and, thus, an electronic device 10 in which the data driver 52A is deployed. To facilitate improving operational efficiency, in some embodiments, a data driver 52 may be implemented and/or operated to bypass its power amplifiers 166 during non-emission periods 132.

Figure 15:
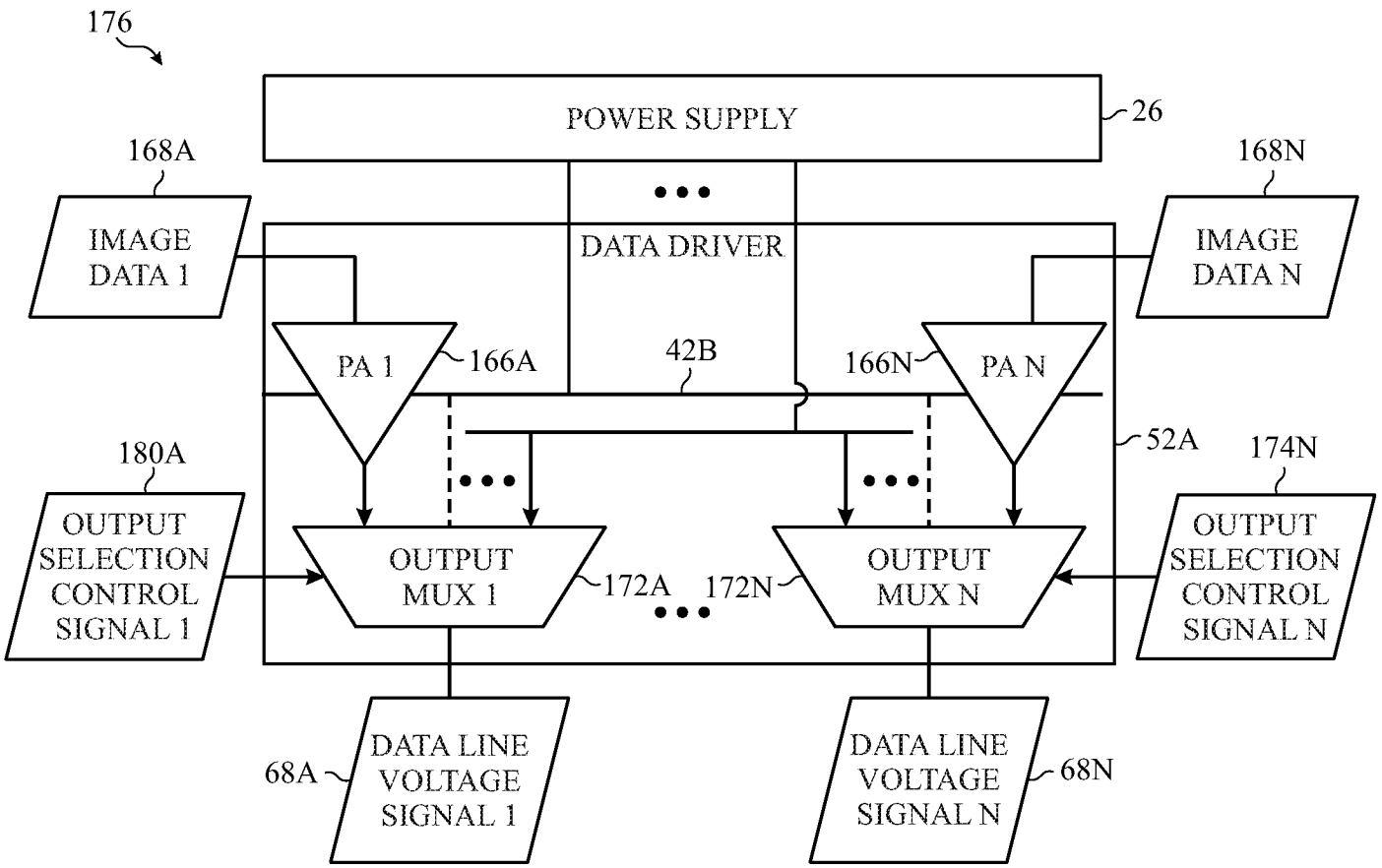
FIG. 15 is a block diagram of an example portion of the electronic device of FIG. 1 including a power supply and the data driver of FIG. 7 implemented with output multiplexers, in accordance with an embodiment of the present disclosure.

To help illustrate, another example of a portion 176 of an electronic device 10, which includes a data driver 52B and a power supply 25, is shown in FIG. 15. As in the depicted example, the data driver 52A may include multiple power amplifiers 166, which is each dedicated to a different data line 58 on a display panel 40. For example, a first power amplifier 166A may be dedicated to a first data line 58A and, thus, receive first image data 168A corresponding with one or more display pixels 54 coupled to the first data line 58A. Similarly, an Nth power amplifier 166N may be dedicated to an Nth data line 58N and, thus, receive Nth image data 168N corresponding with one or more display pixels 54 coupled to the Nth data line 58N.

However, it should be appreciated that the depicted example is merely intended to be illustrative and not limiting. In particular, in other embodiments, a data driver 52 may be coupled to more than two data lines 58 and, thus, include more than two power amplifiers 166. Alternatively or alternatively, in other embodiments, a power amplifier 166 implemented in a data driver 52 may be shared by multiple data lines 58.

As described above, a data driver 52 may facilitate writing an image to display pixels 54 of a display panel 40 by generating data line voltage signals 68 based at least in part on corresponding image data 168, for example, which indicates target luminance (e.g., grayscale level) of the display pixels 54. In other words, during a non-emission period 132, the first power amplifier 166A may be implemented and/or operated to amplifying the first image data 168A to generate a first data line voltage signal 68A supplied to the first data line 58A. Similarly, during the non-emission period 132, the Nth power amplifier 166N may be implemented and/or operated to amplify the Nth image data 168N to generate an Nth data line voltage signal 68N supplied to the Nth data line 58N.

Additionally, as described above, a data driver 52 may facilitate stabilizing pixel luminance by outputting data line voltage signals 68 that include one or more intermediate voltages greater than a ground (e.g., zero) voltage. To facilitate improving operational efficiency, in some embodiments, the data driver 52B may receive one or more of the intermediate voltages to be applied during an emission (e.g., display) period 120 via a power supply rail 42, for example, instead of generating the intermediate voltages via its power amplifiers 166. In fact, to facilitate improving voltage granularity of a target voltage pattern (e.g., target hold voltage and/or target voltage ramp pattern) 170, as in depicted example, the data driver 52B may be electrically coupled to multiple power supply rails 42, which each provides a different voltage. For example, in addition to an amplifier power supply rail 42B, the data driver 52B may also be coupled an additional (e.g., secondary) power supply rail 42C.

In other words, in some embodiments, a data line voltage signal 68 supplied (e.g., output) to a data line 58 may be selectively switched between a voltage signal (e.g., amplified image data) output from a corresponding power amplifier 166 and the voltage provided by a power supply rail 42. To facilitate selectively switching its output, as in the depicted example, the output of the power amplifier 166 and the power supply rail 42 may be coupled to an output multiplexer 178 that outputs the data line voltage signal 68. For example, a first output multiplexer 178A may selectively switch between supplying the output of the first power amplifier 166A (e.g., generated by amplifying the first image data 168A) and voltage of the additional power supply rail 42C as the first data line voltage signal 68A based on a first output selection control signal 180A. Similarly, a Nth output multiplexer 178N may selectively switch between supplying the output of the Nth power amplifier 166N (e.g., generated by amplifying the Nth image data 168N) and voltage of the additional power supply rail 42C as the Nth data line voltage signal 68N based on an Nth output selection control signal 180N.

However, it should again be appreciated that the depicted example is merely intended to be illustrative and not limiting. For example, in other embodiments, multiple additional (e.g., secondary) power supply rails 42C, which each provides a different voltage, may be coupled to an output multiplexer 178. Thus, at least in such embodiments, when a target voltage ramp pattern (e.g., target voltage pattern 170) is to be supplied to a data line 58, the output multiplexer 178 may select the voltage provided by an additional power supply rail 42C at a target ramp time associated with an intermediate voltage that matches the voltage provided by the additional power supply rail 42C. Moreover, in some embodiments, the amplifier power supply rail 42B may also be coupled to an input of an output multiplexer 178, which, at least in some instances, may obviate one or more additional (e.g., secondary) power supply rails 42C, for example, when voltage provided by the amplifier power supply rail 42B matches a target intermediate voltage.

As described above, since power amplifiers 166 generally operate at less than 100% efficiency, continuing to operate the power amplifiers 166 in a data driver 52 during non-emission periods 132 may affect (e.g., reduce) operational efficiency of the data driver 52. In other words, at least in some embodiments, ceasing operation of one or more power amplifiers 166 in the data driver 52B during non-emission periods 132 may facilitate improving operational efficiency of the data driver 52B and, thus, an electronic device 10 in which the data driver 52B is deployed. Accordingly, at least in some embodiments, implementing the data driver 52B to enable the data driver 52B to directly output voltage provided by a power supply rail 42 as an intermediate voltage may facilitate improving operational efficiency, for example, by enabling one or more of its power amplifiers 166 to be bypassed and, thus, power gated.

However, in some embodiments, the number of different voltages that can be provided by the data driver 52B while its power amplifiers 166 are bypassed may be limited by the number power supply rails 42 coupled to its output multiplexers 178. For example, when three power supply rails 42 are coupled to an output multiplexer 178, the data driver 52B may output data line voltage signals 68 with three or fewer intermediate voltage steps. To enable the data driver 52B may output data line voltage signals 68 with more than three intermediate voltage steps while its power amplifiers are bypassed, one or more additional (e.g., secondary) power supply rails 42C may be implemented in the data driver 52B. However, at least in some instances, increasing the number of power supply rails 42 implemented in the data driver 52B may affect (e.g., increase) implementation associated cost, for example, by increasing component count of the data driver 52B, increasing physical footprint of the data driver 52B, and/or increasing the number of manufacturing steps performed to implement the data driver 52B.

In fact, to facilitate improving voltage granularity with lower implementation associated cost, in some embodiments, a data driver 52 may be implemented using a combination of the techniques described with reference to FIG. 14 and the techniques described with reference to FIG. 15. For example, the data driver 52 may be implemented such that an input multiplexer 172, which selectively switches between supply of image data 168 and a target voltage pattern 170, is coupled to an input of a power amplifier 166 and an output multiplexer 178, which selectively switches between supply of a voltage signal output from the power amplifier 166 and voltage provided by one or more power supply rails 42, is coupled to an output of the power amplifier 166. In some embodiments, implementing the data driver 52 in this manner may enable to the data driver 52 to selectively switch between using its power amplifiers 166 and directly using voltage provided by the power supply rails 42 to produce data line voltage signals 68 to be applied during emission periods 120.

For example, to facilitate improving operational efficiency, the data driver 52 may produce a data line voltage signal 68 to be applied during an emission period directly using voltage provided by a power supply rail 42 when the provided voltage matches a target intermediate voltage. On the other hand, to facilitate improving voltage granularity, the data driver 52 may produce a data line voltage signal 68 to be applied during an emission period using its power amplifiers 166 when a target intermediate voltage does not match any of the voltages provided by the power supply rails 42. In this manner, the techniques described in the present disclosure may facilitate improving perceived quality of an image and, thus, a display panel 40 that is displaying the image, for example, by supplying one or more intermediate voltages to data lines 58 of the display panel 40 during display (e.g., emission period 120) of the image, which, at least in some instances, may facilitate reducing likelihood and/or perceivability of visual artifacts, such as a flicker, resulting in the image.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

What is claimed is:

1. An electronic device comprising:

a first display pixel configured to emit light to facilitate displaying a first image during a first emission period; and a data driver coupled to the first display pixel via a first data line, wherein the data driver is configured to:

generate a first data line voltage signal based at least in part on first image data that indicates target luminance of the first display pixel in the first image;

supply the first data line voltage signal to the first data line during a first non-emission period preceding the first emission period to facilitate writing the first image to the first display pixel; and supply a plurality of intermediate voltages to the first data line during the first emission period in which the first image is displayed to offset a first leakage current flowing between a first internal node of the first display pixel and the first data line during the first emission period to thereby reduce luminance variation of the first display pixel.

2. The electronic device of claim 1, comprising a second display pixel coupled to the data driver via a second data line, wherein:

the second display pixel is configured to emit light to facilitate displaying the first image during the first emission period; and the data driver is configured to:

generate a second data line voltage signal based at least in part on second image data that indicates target luminance of the second display pixel in the first image;

supply the second data line voltage signal to the second data line during the first non-emission period preceding the first emission period to facilitate writing the first image to the second display pixel; and supply at least a second intermediate voltage to the second data line during the first emission period in which the first image is displayed to offset a second leakage current flowing between a second internal node of the second display pixel and the second data line during the first emission period, wherein the second intermediate voltage is supplied to the second data line based at least in part on a number of display pixels coupled to the second data line.

3. The electronic device of claim 1, wherein:

the first display pixel is configured to emit light to facilitate displaying a second image during a second emission period different from the first emission period in which the first image is displayed; and the data driver is configured to:

generate a second data line voltage signal based at least in part on second image data that indicates target luminance of the first display pixel in the second image;

supply the second data line voltage signal to the first data line during a second non-emission period preceding the second emission period to facilitate writing the second image to the first display pixel; and supply at least a second intermediate voltage to the first data line during the second emission period in which the second image is displayed to offset a second leakage current flowing between the first internal node of the first display pixel and the first data line during the second emission period, wherein the second intermediate voltage is supplied to the first data line during the second emission period based at least in part on a target display duration of the second image.

4. The electronic device of claim 1, comprising a controller communicatively coupled to the data driver, wherein the controller is configured to:

determine a target display duration of the first image;

instruct the data driver to supply a first intermediate voltage of the plurality of intermediate voltages to the first data line during the first emission period in which the first image is displayed when the target display duration of the first image is greater than a duration threshold; and instruct the data driver to hold the first data line at a ground voltage during the first emission period when the target display duration of the first image is not greater than the duration threshold.

5. The electronic device of claim 1, comprising a controller communicatively coupled to the data driver, wherein the controller is configured to determine a target voltage pattern to be supplied to the first data line during the first emission period in which the first image is displayed based at least in part on a target display duration of the first image, a target refresh rate of the first image, number of display pixels coupled to the first data line, image content of the first image to be displayed by the display pixels coupled to the first data line, or any combination thereof.

6. The electronic device of claim 1, wherein the data driver is configured to:

supply a first intermediate voltage of the plurality of intermediate voltages to the first data line during a first portion of the first emission period in which the first image is displayed; and supply a second intermediate voltage of the plurality of intermediate voltages that is different from the first intermediate voltage to the first data line during a second portion of the first emission period to produce a first change in voltage over time in the first data line that induces a first electrical current in the first display pixel that causes a first voltage change at the first internal node of the first display pixel while the first image is being displayed.

7. The electronic device of claim 6, wherein the data driver is configured to supply a third intermediate voltage of the plurality of intermediate voltages that is different from the first intermediate voltage and the second intermediate voltage to the first data line during a third portion of the first emission period to produce a second change in voltage over time in the first data line that induces a second electrical current in the first display pixel that causes a second voltage change at the first internal node of the first display pixel while the first image is being displayed.

8. The electronic device of claim 1, comprising a second display pixel coupled to the first data line, wherein:

the second display pixel is configured to emit light to facilitate displaying the first image; and the data driver is configured to supply a first intermediate voltage of the plurality of intermediate voltages to the first data line during the first emission period in which the first image is displayed to offset a second leakage current flowing between a second internal node of the second display pixel and the first data line.

9. The electronic device of claim 8, wherein the first display pixel is configured to:

reduce light emission during a first portion of the first emission period in which the first image is displayed due to a first voltage change at the first internal node of the first display pixel resulting from the first leakage current flowing between the first internal node and the first data line; and increase light emission during a second portion of the first emission period due to a second voltage change at the first internal node of the first display pixel resulting from an electrical current induced in the first display pixel by a combined leakage current flowing through the first data line, wherein the combined leakage current comprises the first leakage current and the second leakage current flowing between the second internal node of the second display pixel and the first data line.

10. The electronic device of claim 1, wherein:

the data driver comprises one or more power supply rails each configured to be coupled to a power supply to enable the data driver to receive electrical power from the power supply; and the data driver is configured to connect a first power supply rail of the one or more power supply rails to the first data line during the first emission period in which the first image is displayed when a first voltage of first electrical power provided by the first power supply rail matches a target voltage of a first intermediate voltage of the plurality of intermediate voltages to enable the first intermediate voltage to be supplied to the first data line directly using the first electrical power provided by the first power supply rail.

11. The electronic device of claim 10, wherein:

the data driver comprises a power amplifier coupled to the one or more power supply rails; and the data driver is configured to operate the power amplifier to produce the first intermediate voltage during the first emission period in which the first image is displayed when the first voltage of the first electrical power provided by the first power supply rail does not match the target voltage of the first intermediate voltage.

12. The electronic device of claim 11, wherein the power amplifier is coupled to a second power supply rail of the one or more power supply rails that is configured to provide second electrical power having a second voltage different from the first voltage of the first electrical power provided by the first power supply rail.

13. A method of operating a data driver in an electronic display, comprising:

generating, using the data driver, a first data line voltage signal based at least in part on first image data that indicates target luminance of a first display pixel in a first image to be displayed on the electronic display, wherein the data driver is coupled to the first display pixel via a first data line;

outputting, using the data driver, the first data line voltage signal to the first data line before the first image is displayed at the first display pixel to enable the first data line voltage signal to charge, discharge, or both a first storage capacitor coupled to a first internal node of the first display pixel; and outputting, using the data driver, a first voltage ramp pattern comprising a plurality of voltages to the first data line while the first image is being displayed at the first display pixel to offset a first leakage current flowing between the first storage capacitor of the first display pixel and the first data line during display of the first image.

14. The method of claim 13, comprising:

generating, using the data driver, a second data line voltage signal based at least in part on second image data that indicates target luminance of a second display pixel in the first image to be displayed on the electronic display, wherein the data driver is coupled to the second display pixel via a second data line;

outputting, using the data driver, the second data line voltage signal to the second data line before the first image is displayed at the second display pixel to enable the second data line voltage signal to charge, discharge, or both a second storage capacitor coupled to a second internal node of the second display pixel; and outputting, using the data driver, a second voltage ramp pattern comprising one or more voltages to the second data line while the first image is being displayed at the second display pixel to offset a second leakage current flowing between the second storage capacitor of the second display pixel and the second data line during display of the first image, wherein the second voltage ramp pattern is different from the first voltage ramp pattern output to the first data line in response to determining that the first data line and the second data line are coupled to differing numbers of display pixels.

15. The method of claim 13, comprising:

generating, using the data driver, a second data line voltage signal based at least in part on second image data that indicates target luminance of the first display pixel in a second image to be displayed on the electronic display;

outputting, using the data driver, the second data line voltage signal to the first data line before the second image is displayed at the first display pixel to enable the second data line voltage signal to charge, discharge, or both the first storage capacitor coupled to the first internal node of the first display pixel; and outputting, using the data driver, a second voltage ramp pattern comprising one or more voltages to the first data line while the second image is being displayed at the first display pixel to offset a second leakage current flowing between the first storage capacitor of the first display pixel and the first data line during display of the second image, wherein the second voltage ramp pattern is different from the first voltage ramp pattern output to the first data line in response to determining that a first target refresh rate of the first image is different from a second target refresh rate of the second image.

16. The method of claim 13, comprising determining, using control circuitry communicatively coupled to the data driver, target parameters of the first voltage ramp pattern to be output to the first data line while the first image is being displayed at the first display pixel based at least in part on a target display duration of the first image, a target refresh rate of the first image, number of display pixels coupled to the first data line, image content of the first image to be displayed at the display pixels coupled to the first data line, or any combination thereof.

17. The method of claim 13, wherein outputting the first voltage ramp pattern to the first data line while the first image is being displayed at the first display pixel comprises:

ramping voltage of the first data line up from a ground voltage to a first voltage of the plurality of voltages at a first target ramp time;

holding the voltage of the first data line at the first voltage until a second target ramp time is reached; and ramping the voltage of the first data line up from the first voltage to a second voltage of the plurality of voltages at the second target ramp time after the first target ramp time.

18. The method of claim 17, wherein:

generating the first data line voltage signal comprises amplifying magnitude of the first image data using a power amplifier implemented in the data driver;

outputting the first voltage ramp pattern to the first data line comprises power gating the power amplifier;

ramping the voltage of the first data line up from the ground voltage to the first voltage comprises connecting a first power supply rail that supplies first electrical power with a first supply voltage that matches the first voltage to the first data line at the first target ramp time; and ramping the voltage of the first data line up from the first voltage to the second voltage comprises connecting a second power supply rail that supplies second electrical power with a second supply voltage that matches the second voltage to the first data line at the second target ramp time.

19. A tangible, non-transitory, computer-readable medium storing instructions executable by processing circuitry in an electronic device, wherein the instructions comprise instructions to:

determine, using the processing circuitry, number of display pixels coupled to a data line implemented on a display panel;

determine, using the processing circuitry, a target display duration of an image to be displayed on the display panel; and in response to determining that the target display duration of the image is greater than a duration threshold:

determine, using the processing circuitry, a target voltage ramp pattern to be applied to the data line during display of the image on the display panel based at least in part on the target display duration of the image and the number of display pixels coupled to the data line; and instruct, using the processing circuitry, a data driver coupled to the data line to supply the target voltage ramp pattern comprising a plurality of intermediate voltages to the data line while the image is being displayed on the display panel to capacitively induce a change in a voltage of the display pixels over time that charges, discharges, or both the display pixels coupled to the data line while one or more of the display pixels are emitting light.

20. The tangible, non-transitory, computer-readable medium of claim 19, wherein the instructions to determine the target voltage ramp pattern comprise instructions to:

select a first candidate voltage ramp pattern comprising the plurality of voltage steps in response to determining that the target display duration of the image is a first duration and the data line is coupled to a first number of display pixels;

select a second candidate voltage ramp pattern comprising more voltage steps compared to the first candidate voltage ramp pattern in response to determining that:

the target display duration of the image is the first duration and the data line is coupled to a second number of display pixels greater than the first number; or the target display duration of the image is a second duration greater than the first duration and the data line is coupled to the first number of display pixels; and select a third candidate voltage ramp pattern comprising more voltage steps compared to the second candidate voltage ramp pattern in response to determining that the target display duration of the image is the second duration greater than the first duration and the data line is coupled to the second number of display pixels greater than the first number.

* * * * *